US009958191B2

(12) United States Patent
Kawano et al.

(10) Patent No.: US 9,958,191 B2
(45) Date of Patent: May 1, 2018

(54) REFRIGERATION APPARATUS

(71) Applicant: DAIKIN INDUSTRIES, LTD., Osaka-shi, Osaka (JP)

(72) Inventors: Satoshi Kawano, Sakai (JP); Shinya Matsuoka, Sakai (JP); Masahiro Oka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 667 days.

(21) Appl. No.: 14/402,668

(22) PCT Filed: Apr. 19, 2013

(86) PCT No.: PCT/JP2013/061596
§ 371 (c)(1),
(2) Date: Nov. 20, 2014

(87) PCT Pub. No.: WO2013/175912
PCT Pub. Date: Nov. 28, 2013

(65) Prior Publication Data

US 2015/0096321 A1 Apr. 9, 2015

(30) Foreign Application Priority Data

May 23, 2012 (JP) ..... 2012-117801
Dec. 18, 2012 (JP) ..... 2012-276151

(51) Int. Cl.
*F25B 41/04* (2006.01)
*F25D 19/00* (2006.01)
(Continued)

(52) U.S. Cl.
CPC ..... *F25B 49/027* (2013.01); *F25B 1/10* (2013.01); *F25B 9/002* (2013.01); *F25B 13/00* (2013.01);
(Continued)

(58) Field of Classification Search
CPC .. F25B 13/00; F25B 1/10; F25B 2313/02741; F25B 9/002
(Continued)

(56) References Cited

U.S. PATENT DOCUMENTS 6,481,229 B1 * 11/2002 Yajima ..... F25B 41/062 236/84
8,079,229 B2 12/2011 Lifson et al.
(Continued)

FOREIGN PATENT DOCUMENTS

JP 2-11886 A 1/1990
JP 10-318614 A 12/1998
(Continued)

OTHER PUBLICATIONS

International Search Report of corresponding PCT Application No. PCT/JP20131061596 dated Jul. 16, 2013.
(Continued)

*Primary Examiner* — Henry Crenshaw
(74) *Attorney, Agent, or Firm* — Global IP Counselors, LLP

(57) ABSTRACT

A refrigeration apparatus uses R32 as a refrigerant, and includes a compressor, a condenser, an expansion mechanism, an evaporator, an intermediate injection channel and a suction injection channel. The intermediate injection channel guides a part of the refrigerant flowing from the condenser toward the evaporator to the compressor, causing the refrigerant to merge with intermediate-pressure refrigerant of the compressor. The suction injection channel guides a part of the refrigerant flowing from the condenser toward the evaporator to the suction passage, causing the refrigerant to merge with low-pressure refrigerant sucked into the compressor.

8 Claims, 9 Drawing Sheets

(51) Int. Cl.

| | |
|---|---|
| ***F25B 49/02*** | (2006.01) |
| ***F25B 1/10*** | (2006.01) |
| ***F25B 9/00*** | (2006.01) |
| ***F25B 13/00*** | (2006.01) |

(52) U.S. Cl.
CPC . *F25B 2313/006* (2013.01); *F25B 2313/0233* (2013.01); *F25B 2313/0272* (2013.01); *F25B 2313/02741* (2013.01); *F25B 2400/13* (2013.01); *F25B 2600/2509* (2013.01); *F25B 2600/2517* (2013.01); *F25B 2700/2103* (2013.01); *F25B 2700/21152* (2013.01)

(58) Field of Classification Search
USPC ..... 62/225, 498
See application file for complete search history.

(56) References Cited

U.S. PATENT DOCUMENTS

2007/0151266 A1* 7/2007 Yakumaru ..... F25B 1/10 62/197
2008/0184723 A1* 8/2008 Sato ..... F04C 23/008 62/228.1
2008/0276629 A1* 11/2008 Yamamoto ..... F25C 1/145 62/71
2009/0165481 A1* 7/2009 Ko ..... F25B 49/005 62/195
2009/0241569 A1* 10/2009 Okada ..... F25B 40/00 62/196.1
2010/0192607 A1* 8/2010 Unezaki ..... F25B 13/00 62/238.7
2010/0229583 A1* 9/2010 Komori ..... F24D 3/08 62/238.7

FOREIGN PATENT DOCUMENTS

| | | | | |
|---|---|---|---|---|
| JP | 2003-185286 | A | | 7/2003 |
| JP | 2007-263443 | A | | 10/2007 |
| JP | 2007263443 | A | * | 10/2007 |
| JP | 2008-180420 | A | | 8/2008 |
| JP | 2009-127902 | A | | 6/2009 |
| JP | 2012-17951 | A | | 1/2012 |

OTHER PUBLICATIONS

European Search Report of divisional application of corresponding EP Application No. 16 18 5217.3 dated Feb. 3, 2017.
European Search Report of corresponding EP Application No. 13 79 3423.8 dated May 3, 2016.
European Search Report of divisional application of corresponding EP Application No. 16 18 5220 dated Jul. 25, 2017.
International Preliminary Report of corresponding PCT Application No. PCT/JP2013/061596 dated Nov. 25, 2014.

* cited by examiner

REFRIGERATION APPARATUS

CROSS-REFERENCE TO RELATED APPLICATIONS

This U.S. National stage application claims priority under 35 U.S.C. § 119(a) to Japanese Patent Application Nos. 2012-117801, filed in Japan on May 23, 2012, and 2012-276151, filed in Japan on Dec. 18, 2012, the entire contents of which are hereby incorporated herein by reference.

TECHNICAL FIELD

The present invention relates to a refrigeration apparatus, and more specifically, a refrigeration apparatus that uses R32 as a refrigerant.

BACKGROUND ART

In the conventional art, among refrigeration apparatuses such as air conditioning apparatuses and like, there have been proposed apparatuses that use R32 as the refrigerant. When using R32 as the refrigerant, the discharge temperature of the compressor tends to be higher in comparison to the case of using R410A or R22 as the refrigerant. Recognizing this problem, an air conditioning apparatus that lowers the refrigerant discharge temperature while using R32 refrigerant is disclosed in Japanese Laid-open Patent Application No. 2009-127902. In this air conditioning apparatus, part of the liquid refrigerant exiting from a liquid gas separator provided to a high-pressure line is caused to bypass to a compressor, that bypassed refrigerant then being converted to a flash gas state in an internal heat exchanger. That refrigerant, bypassed to the compressor and converted into a flash gas is injected, lowering the enthalpy of refrigerant in an intermediate-pressure state in the compressor, causing a decrease in the discharge temperature of refrigerant of the compressor.

SUMMARY

Technical Problem

In the air conditioning apparatus disclosed in Japanese Laid-open Patent Application No. 2009-127902, the refrigerant that has become a flash gas and is flowed in a bypass is injected into intermediate-pressure refrigerant in the compressor, lowering the discharge temperature of the compressor and improving operating capacity, however depending on the operating conditions, there may be cases in which an increase in operating capacity through intermediate injection causes a deterioration in operating efficiency. In this case, although stopping the intermediate injection is conceivable, if that is done the discharge temperature rises, which may make continuous operation difficult.

An object of the present invention is to provide a refrigeration apparatus that uses R32 as the refrigerant, in which injection can be performed in order to suppress the discharge temperature of the compressor even in the case in which, with intermediate injection, operating efficiency deteriorates.

Solution to the Problem

A refrigeration apparatus according to a first aspect of the present invention uses R32 as the refrigerant, and is provided with a compressor, a condenser, an expansion mechanism, an evaporator, an intermediate injection channel and a suction injection channel. The compressor sucks in low-pressure refrigerant from a suction passage, compresses the refrigerant and discharges high-pressure refrigerant. The condenser condenses high-pressure refrigerant discharged from the compressor. The expansion mechanism expands the high-pressure refrigerant that exists the condenser. The evaporator evaporates the refrigerant expanded by the expansion mechanism. The intermediate injection channel guides a part of the refrigerant flowing from the condenser toward the evaporator to the compressor, and merges the refrigerant with intermediate-pressure refrigerant of the compressor. The suction injection channel guides a part of the refrigerant flowing from the condenser toward the evaporator to the suction passage, and merges the refrigerant with low-pressure refrigerant sucked into the compressor.

This refrigeration apparatus according to the present invention enables a part of the refrigerant flowing from the condenser toward the evaporator to be merged, using the intermediate injection channel, with intermediate-pressure refrigerant of the compressor, and, using the suction injection channel, enables part of the refrigerant flowing from the condenser toward the evaporator to be merged with low-pressure refrigerant in the suction passage that is sucked into the compressor. Accordingly, even in the case in which operating efficiency would deteriorate if using the intermediate injection channel, it is possible to reduce the discharge temperature of the compressor using the suction injection channel.

A refrigeration apparatus according to a second aspect of the present invention is the refrigeration apparatus according to the first aspect further provided with switching mechanism. The switching mechanism switches between an intermediate injection condition that flows refrigerant in the intermediate injection channel, and a suction injection condition that flows refrigerant in the suction injection channel.

Here, in the intermediate injection condition a part of the refrigerant flowing from the condenser toward the evaporator passes through the intermediate injection channel and is merged with the intermediate-pressure refrigerant of the compressor. On the other hand, in the suction injection condition, a part of the refrigerant flowing from the condenser toward the evaporator passes through the suction injection channel and is merged with low-pressure refrigerant in the suction passage that is sucked into the compressor. Because it is possible to switch between this intermediate injection condition and the suction injection condition using the switching mechanism, even in the case in which operating efficiency would deteriorate under intermediate injection, the switching mechanism switches from the intermediate injection condition to the suction injection condition thereby enabling the discharge temperature of the compressor to be reduced.

A refrigeration apparatus according to a third aspect of the present invention is the refrigeration apparatus according to the second aspect further provided with a branch flow channel, an opening adjustable valve and a heat exchanger for injection. The branch flow channel is a channel that branches from a main refrigerant channel joining the condenser and the evaporator. The opening adjustable valve is provided to the branch flow channel, and has an adjustable opening. The heat exchanger for injection exchanges heat between the refrigerant flowing in the main refrigerant channel and the refrigerant flowing downstream of the opening adjustable valve of the branch flow channel. In this refrigeration apparatus, the refrigerant that exits the heat exchanger for injection and flows in the branch flow channel flows in the intermediate injection channel or the suction injection channel.

Here, the refrigerant flowing to the compressor either via the intermediate injection channel or via the suction injection channel, is depressurized at the opening adjustable valve provided to the branch flow channel and subjected to heat exchange at the heat exchanger for injection. Accordingly, it is possible, by controlling the adjustment of the degree of opening of the opening adjustable valve, to make the refrigerant caused to merge with the intermediate-pressure refrigerant in the compressor or with the low-pressure refrigerant sucked into the compressor, superheated gas or flash gas.

Thus, in the case for example when usually injection is performed using refrigerant that has been superheated, it is possible to perform injection that emphasizes cooling using wet flash gas in a gas-liquid two-phase state when the discharge temperature of the compressor becomes high.

A refrigeration apparatus according to a fourth aspect of the present invention is the refrigeration apparatus according to either the second aspect or the third aspect, further provided with a discharge temperature sensor for detecting the temperature of the refrigerant discharged from the compressor, and a control part. The control part selectively implements intermediate injection control or suction injection control. Intermediate injection control is an intermediate injection condition of the switching mechanism that flows refrigerant to the intermediate injection channel. Suction injection control is a suction injection condition of the switching mechanism that flows refrigerant to the suction injection channel. Further, the control part performs suction injection control when the discharge temperature detected by the discharge temperature sensor is higher than a temperature threshold value, moreover, the rotational speed of the compressor is below a rotational speed threshold value.

It is preferable, if the discharge temperature detected by the discharge temperature sensor is higher than the temperature threshold, for a part of the refrigerant flowing from the condenser toward the evaporator to be injected to the compressor either directly or via the injection channel, in order that the discharge temperature be below the temperature threshold. However, when operating at low thermal load with reduced rotational speed of the compressor, such as the heating operation when the external air temperature is high, if the intermediate injection control is implemented, capacity increases, the pressure (high pressure) of refrigerant discharged by the compressor increasing substantially. Accordingly the refrigeration apparatus according to this fourth aspect of the present invention performs suction injection control when the discharge temperature detected by the discharge temperature sensor is higher than the temperature threshold value, moreover, when the rotational speed of the compressor is below the rotational speed threshold value. Thus, even in the case of low thermal load, while suppressing wasteful increase in capacity and ensuring operating efficiency, the discharge temperature can be reduced through suction injection control.

A refrigeration apparatus according to a fifth aspect of the present invention is the refrigeration apparatus according to the third aspect, further provided with a first temperature sensor, a second temperature sensor, and a control part. The first temperature sensor detects the temperature of refrigerant discharged from the compressor. The second temperature sensor detects the temperature of refrigerant that comes out of the heat exchanger for injection, and flows in the branch flow channel. The control part selectively implements intermediate injection control and suction injection control. Intermediate injection control is an intermediate injection condition of the switching mechanism that flows refrigerant to the intermediate injection channel. Suction injection control is a suction injection condition of the switching mechanism that flows refrigerant to the suction injection channel. The control part, in the intermediate injection control, adjusts the opening degree of the opening adjustable valve based on the detected temperature of the second temperature sensor when the temperature detected by the first temperature sensor is below a first threshold value. Further, the control part, in the intermediate injection control, adjusts the opening degree of the opening adjustable valve based on the detected temperature of the first temperature sensor when the temperature detected by the first temperature sensor is higher than the first threshold value.

It is possible to have an increase in capacity or efficiency by performing intermediate injection control, however if the discharge temperature of the compressor rises to a level that becomes problematic for continuous operation, it becomes necessary to implement droop control, that forcefully lowers the rotational speed of the compressor. In order to avoid this, the refrigeration apparatus according to the fifth aspect of the present invention adjusts the opening of the opening adjustable valve based on the temperature detected by the first temperature sensor and not the temperature detected by the second temperature sensor, when the temperature detected by the first temperature sensor that detects the temperature of refrigerant discharged from the compressor is higher than the first threshold value. Thus, in order to reduce the detected temperature of the first temperature sensor that is the discharge refrigerant temperature of the compressor, it is possible for example, to increase the degree of opening of the opening adjustable valve, injecting wet refrigerant gas to the compressor, to achieve increased cooling effect. On the other hand, when the temperature detected by the first temperature sensor is below the first threshold value, opening adjustment is performed based on the temperature detected by the second temperature sensor that detects the temperature of refrigerant exiting from the heat exchanger for injection, enabling operating efficiency to be ensured.

A refrigeration apparatus according to a sixth aspect of the present invention is the refrigeration apparatus according to the first aspect or the second aspect, further provided with a refrigerant storage tank and a bypass channel. The refrigerant storage tank is provided to the main refrigerant channel joining the condenser and the evaporator. The gas component of refrigerant accumulated inside the refrigerant storage tank is guided to the intermediate injection channel or the suction injection channel.

Here, the refrigerant that flows to the compressor via the intermediate injection channel or the suction injection channel becomes the gas component of refrigerant accumulated inside the refrigerant storage tank. That is, the saturated gas of refrigerant in the refrigerant storage tank comes to flow to the compressor. With this configuration, an additional heat exchanger for converting liquid refrigerant for injection to flash gas or superheated gas is not required, thereby holding down the production cost of the refrigeration apparatus.

A refrigeration apparatus according to a seventh aspect of the present invention is the refrigeration apparatus according to the second aspect, in which the switching mechanism has a first opening/closing mechanism provided to the intermediate injection channel and a second opening/closing mechanism provided to the suction injection channel.

Here, as the intermediate injection channel can be closed by the first opening/closing mechanism, or the suction injection channel can be closed by the second opening/closing mechanism, the effect of switching between the intermediate injection condition and the suction injection condition is achieved definitively.

Note that the first opening/closing mechanism and the second opening/closing mechanism may be provided as two individual opening adjustment valves, and may also be provided as a single mechanism such as a three-way valve.

A refrigeration apparatus according to an eighth aspect of the present invention, is the refrigeration apparatus according to the fourth aspect, in which the switching mechanism is a mechanism that switches between the intermediate injection condition, the suction injection condition, and a non-injection condition. The non-injection condition is a condition in which refrigerant does not flow to either the intermediate injection channel or the suction injection channel. The control part selectively implements intermediate injection control, suction injection control, and non-injection control. Non-injection control is a non-injection condition of the switching mechanism that does not flow refrigerant to either the intermediate injection channel or the suction injection channel. Further, the control part selectively implements non-injection control when the discharge temperature detected by the discharge temperature sensor is below the temperature threshold value, moreover, the rotational speed of the compressor is below the rotational speed threshold value.

Here, in the case in which it is not necessary to lower the discharge temperature of the compressor through suction injection or intermediate injection as the discharge temperature is low, moreover, the rotational speed of the compressor is decreased as low capacity is required, non-injection control is selected and implemented. Thus, decreased operating efficiency and an increase in capacity through suction injection or intermediate injection are suppressed, and operating efficiency is ensured while the requirements of low capacity can be satisfied.

A refrigeration apparatus according to a ninth aspect of the present invention, is the refrigeration apparatus according to either the second aspect or the seventh aspect in which the switching mechanism switches between the intermediate injection condition, the suction injection condition and a non-injection condition. The non-injection condition is a condition in which refrigerant does not flow to either the intermediate injection channel or the suction injection channel.

Here, in the case in which it is not necessary to lower the discharge temperature of the compressor through suction injection or intermediate injection as the discharge temperature is low, moreover, the rotational speed of the compressor is decreased as low capacity is required, it is possible to switch to non-injection control. When that switch is implemented, decreased operating efficiency and an increase in capacity through suction injection or intermediate injection are suppressed, and operating efficiency is ensured while the requirements of low capacity can be satisfied.

Advantageous Effects of Invention

The refrigeration apparatus according to the first aspect of the present invention enables the discharge temperature of the compressor to be lowered using the suction injection channel, even in the case in which operating efficiency deteriorates using the intermediate injection channel.

The refrigeration apparatus according to the second aspect of the present invention enables the discharge temperature of the compressor to be lowered by switching from the intermediate injection condition to the suction injection condition, even in the case in which operating efficiency deteriorates with intermediate injection.

The refrigeration apparatus according to the third aspect of the present invention, by controlling the adjustment of the degree of opening of the opening adjustable valve, enables the refrigerant caused to merge with the low-pressure refrigerant sucked into the compressor or the intermediate-pressure refrigerant of the compressor to become superheated gas or flash gas.

The refrigeration apparatus according to the fourth aspect of the present invention enables the discharge temperature that has become higher than a temperature threshold value to be lowered through suction injection control, while suppressing wasteful increase in capacity and ensuring operating efficiency, even in the case of low load.

The refrigeration apparatus according to the fifth aspect of the present invention adjusts the opening degree of the opening adjustable valve based on the temperature detected by the first temperature sensor and not the temperature detected by the second temperature sensor, when the temperature detected by the first temperature sensor for detecting the temperature of refrigerant discharged from the compressor, is higher than the first threshold value. Thus, in order to lower the temperature detected by the first temperature sensor that is the discharge temperature of refrigerant of the compressor, the cooling effect can be increased by for example, increasing the degree of opening of the opening adjustable valve and injecting wet refrigerant gas to the compressor.

The refrigeration apparatus according to the sixth aspect of the present invention holds down the production costs of the refrigeration apparatus as a heat exchanger for converting liquid refrigerant for injection into flash gas or superheated gas is not required in addition to the refrigerant storage tank.

The refrigeration apparatus according to the seventh aspect of the present invention enables shut off of the intermediate injection channel or shut off of the suction injection channel to be performed definitively, improving the effect of switching between the intermediate injection condition and the suction injection condition.

In the refrigeration apparatuses according to the eighth aspect and the ninth aspect of the present invention, if the switch to the non-injection condition is implemented under predetermined conditions, an increase in capacity through suction injection or intermediate injection and substantial decrease in operating efficiency are suppressed, enabling operating efficiency to be ensured while satisfying the requirements of low capacity.

DESCRIPTION OF EMBODIMENTS

Figure 1:
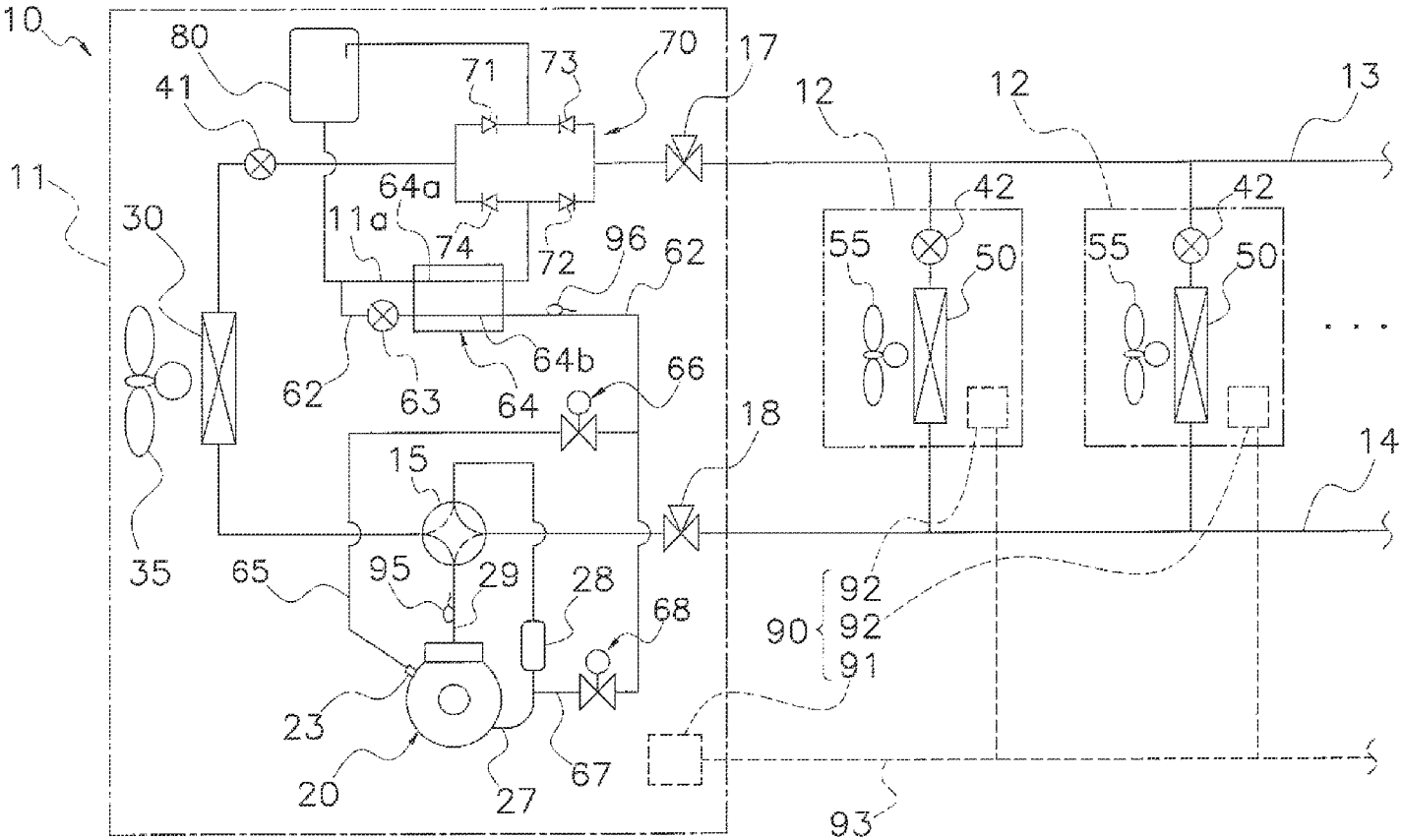
FIG. 1 shows the refrigerant piping system of an air conditioning apparatus according to a first embodiment of the present invention.

First Embodiment (1) Overall Configuration of the Air Conditioning Apparatus FIG. 1 shows the refrigerant piping system of an air conditioning apparatus 10 that is a refrigeration apparatus according to a first embodiment of the present invention. The air conditioning apparatus 10 is a distributed refrigerant piping system air conditioning apparatus that cools and heats each room inside a building by vapor compression type refrigerant cycle operation. The air conditioning apparatus 10 is provided with an outdoor unit 11 as a heat source unit, a plurality of indoor units 12 as usage-side units, and a liquid refrigerant communication pipe 13 and gas refrigerant communication pipe 14 as refrigerant communication pipes that connect the outdoor unit 11 to the indoor units 12. That is, the refrigerant circuit of the air conditioning apparatus 10 shown in FIG. 1, is configured such that the outdoor unit 11, the indoor units 12, the liquid refrigerant communication pipe 13 and the gas refrigerant communication pipe 14 are connected.

Refrigerant is sealed in the refrigerant circuit shown in FIG. 1, and as described subsequently, is subjected in that circuit to the operations of a refrigerant cycle in which the refrigerant is compressed, cooled and condensed, depressurized, then heated and evaporated, after which the refrigerant is compressed again. R32 is used as the refrigerant. R32 is a low GWP refrigerant with a low warming coefficient, a type of HFC refrigerant. Further, an ether-based synthetic oil having some degree of compatibility with R32 is used as the refrigerator oil.

(2) Detailed Configuration of the Air Conditioning Apparatus (2-1) Indoor Units

The indoor units 12 are installed on the ceiling or a side wall in each room and are connected to the outdoor unit 11 via the refrigerant communication pipes 13 and 14. The indoor unit 12 has primarily, an indoor expansion valve 42 that is a pressure reducer and an indoor heat exchanger 50 as a usage-side heat exchanger.

The indoor expansion valve 42 is an expansion mechanism that depressurizes the refrigerant, being an electronic valve having an adjustable opening. One end of the indoor expansion valve 42 is connected to the liquid refrigerant communication pipe 13 and the other end is connected to the indoor heat exchanger 50.

The indoor heat exchanger 50 is a heat exchanger that functions as an evaporator or a condenser of refrigerant. One end of the indoor heat exchanger 50 is connected to the indoor expansion valve 42 and the other end is connected to the gas refrigerant communication pipe 14.

The indoor unit 12 has an indoor fan 55 for sucking in indoor air and resupplying the air indoors, facilitating exchange of heat between the indoor air and the refrigerant flowing in the indoor heat exchanger 50.

Further, the indoor unit 12 has an indoor control part 92 for controlling the operation of the various parts comprising the indoor unit 12 and the various sensors. The indoor control part 92 has a microcomputer, memory and the like for performing control of the indoor unit 12, and exchanges control signals and the like with a remote control part (not shown in the drawing) for individually operating the indoor unit 12, while also exchanging control signals and the like with an outdoor control part 91 of the outdoor unit 11 described subsequently, via a transmission line 93.

(2-2) Outdoor Unit

The outdoor unit 11 is installed either outside or in the basement of the building having each room in which an indoor unit 12 is deployed, and is connected to the indoor units 12 via the refrigerant communication pipes 13 and 14. Primarily, the outdoor unit 11 has a compressor 20, a four-way switching valve 15, an outdoor heat exchanger 30, an outdoor expansion valve 41, a bridge circuit 70, a high-pressure receiver 80, an electric injection valve 63, a heat exchanger for injection 64, an intermediate injection switching valve 66, a suction injection switching valve 68, a liquid-side shut off valve 17, and a gas-side shut off valve 18.

The compressor 20 is a hermetically sealed compressor driven by a compressor motor. In this embodiment there is one compressor 20, however this is illustrative and not restrictive, and it is possible to have two or more compressors 20 connected in parallel, depending on the number of connected indoor units 12. The compressor 20 sucks the gas refrigerant from a suction passage 27 via a vessel 28 appurtenant to the compressor 20. A discharge pressure sensor for detecting the pressure of discharged refrigerant, and a discharge temperature sensor 95 for detecting the temperature of discharged refrigerant are mounted to a discharge-side refrigerant pipe 29 of the compressor 20. Further, an intake temperature sensor for detecting the temperature of the refrigerant sucked into the compressor 20 is mounted to the suction passage 27. Note that the compressor 20 has an intermediate injection port 23 described subsequently.

The four-way switching valve 15 is a mechanism for switching the direction of refrigerant flow. The four-way switching valve 15 connects the discharge-side refrigerant pipe 29 of the compressor 20 and one end of the outdoor heat exchanger 30, and connects the suction passage 27 of the compressor 20 (including the vessel 28) with the gas-side shut off valve 18 (refer the solid line of the four-way switching valve 15 in FIG. 1), such that during the cooling operation, the outdoor heat exchanger 30 is caused to function as a condenser of refrigerant compressed by the compressor 20 and the indoor heat exchanger 50 is caused to function as an evaporator of refrigerant cooled in the outdoor heat exchanger 30. Further, the four-way switching valve 15 connects the discharge-side refrigerant pipe 29 of the compressor 20 and the gas-side shut off valve 18, and connects the suction passage 27 to one end of the outdoor heat exchanger 30 (refer the dashed line of the four-way switching valve 15 in FIG. 1), such that during the heating operation, the indoor heat exchanger 50 is caused to function as a condenser of refrigerant compressed by the compressor 20 and the outdoor heat exchanger 30 is caused to function as an evaporator of refrigerant cooled in the indoor heat exchanger 50. In this embodiment, the four-way switching valve 15 is a four-way valve connected to the suction passage 27, the discharge-side refrigerant pipe 29 of the compressor 20, the outdoor heat exchanger 30 and the gas-side shut off valve 18.

The outdoor heat exchanger 30 is a heat exchanger that functions as a condenser and an evaporator of refrigerant. One end of the outdoor heat exchanger 30 is connected to the four-way switching valve 15, while the other end is connected to the outdoor expansion valve 41.

The outdoor unit 11 has an outdoor fan 35 that sucks outdoor air into itself and expels the air again outdoors. The outdoor fan 35 facilitates exchange of heat between outdoor air and the refrigerant flowing in the outdoor heat exchanger 30, and is driven by an outdoor fan motor. Note that the heat source of the outdoor heat exchanger 30 is not restricted to outside air and it is suitable to use a different heating medium such as water or the like.

The outdoor expansion valve 41 is an expansion mechanism for depressurizing the refrigerant, and is an electric valve having an adjustable opening. One end of the outdoor expansion valve 41 is connected to the outdoor heat exchanger 30 and the other end is connected to the bridge circuit 70.

The bridge circuit 70 has four check valves, 71, 72, 73 and 74. The inlet check valve 71 is a check valve that allows the refrigerant from the outdoor heat exchanger 30 to flow only toward the high-pressure receiver 80. The outlet check valve 72 is a check valve that allows the refrigerant from the high-pressure receiver 80 to flow only toward the indoor heat exchanger 50. The inlet check valve 73 is a check valve that allows the refrigerant from the indoor heat exchanger 50 to flow only toward the high-pressure receiver 80. The outlet check valve 74 is a check valve that allows the refrigerant from the high-pressure receiver 80 to flow only toward the outdoor heat exchanger 30 via the outdoor expansion valve 41. That is, the inlet check valves 71 and 73 fulfill the function of flowing refrigerant from one of the outdoor heat exchanger 30 and the indoor heat exchanger 50 to the high-pressure receiver 80, while the outlet check valves 72 and 74 fulfill the function of flowing refrigerant from the high-pressure receiver 80 to the other of the outdoor heat exchanger 30 and the indoor heat exchanger 50.

The high-pressure receiver 80 is a container disposed between the outdoor expansion valve 41 and the liquid-side shut off valve 17 that functions as a refrigerant storage tank. During the cooling operation and during the heating operation, the high-pressure receiver 80, into which high-pressure refrigerant has flowed, is not subject to the occurrence of the adverse phenomena in which excess refrigerant, including refrigerator oil, separates into two layers, with the refrigerator oil accumulating in the upper portion because the surplus refrigerant that accumulates in the high-pressure receiver 80 is kept at a relatively high temperature.

A heat exchanger for injection 64 is provided between the outlet of the high-pressure receiver 80 and the outlet check valves 72 and 74 of the bridge circuit 70. A branch flow pipe 62 branches from a part of the main refrigerant channel 11*a* that connects the outlet of the high-pressure receiver 80 and the heat exchanger for injection 64. The main refrigerant channel 11*a* is the main channel for liquid refrigerant, and connects the outdoor heat exchanger 30 and the indoor heat exchanger 50. The high-pressure receiver 80 is disposed between the outdoor expansion valve 41 and the liquid-side shut off valve 17 along the main refrigerant channel 11*a*.

The electric injection valve 63, having an adjustable opening, is provided to the branch flow pipe 62. Further, the branch flow pipe 62 is connected to a second channel 64*b* of the heat exchanger for injection 64. That is, when the electric injection valve 63 is open, the refrigerant diverged from the main refrigerant channel 11*a* to the branch flow pipe 62 is depressurized at the electric injection valve 63, and flows to the second channel 64*b* of the heat exchanger for injection 64. Note that the second channel 64*b* of the heat exchanger for injection 64 configures a part of the branch flow pipe 62.

The refrigerant depressurized at the electric injection valve 63 and flowed to the second channel 64*b* of the heat exchanger for injection 64 is subject to heat exchange with the refrigerant flowing in a first channel 64*a* of the heat exchanger for injection 64. The first channel 64*a* of the heat exchanger for injection 64 configures a part of the main refrigerant channel 11*a*. After being subjected to heat exchange at the heat exchanger for injection 64 the refrigerant will flow to the branch flow pipe 62, and come to be flowed into an intermediate injection channel 65 or a suction injection channel 67 described subsequently. Further, an injection temperature sensor 96 for detecting the temperature of refrigerant after heat exchange at the heat exchanger for injection 64 is installed to the branch flow pipe 62 to the downstream side of the heat exchanger for injection 64.

The heat exchanger for injection 64 is an internal heat exchanger employing a double tube structure that performs heat exchange, as described above, between the refrigerant flowing in the main refrigerant channel 11*a* that is the main path, and the refrigerant for injection diverged from the main refrigerant channel 11*a* and flowing in the branch flow pipe 62. One end of the first channel 64*a* of the heat exchanger for injection 64 is connected to the outlet of the high-pressure receiver 80, while the other end connects to the outlet check valves 72 and 74 of the bridge circuit 70.

The liquid-side shut off valve 17 is a valve connected to the liquid refrigerant communication pipe 13 that functions to exchange refrigerant between the outdoor unit 11 and the indoor unit 12. The gas-side shut off valve 18 is a valve connected to the gas refrigerant communication pipe 14 that functions to exchange refrigerant between the outdoor unit 11 and the indoor unit 12, the gas-side shut off valve 18 being connected to the four-way switching valve 15. Here, the liquid-side shut off valve 17 and the gas-side shut off valve 18 are three-way valves provided with service ports.

The vessel 28 is arranged in the suction passage 27 between the four-way switching valve 15 and the compressor 20, and fulfills the function of preventing liquid refrigerant from being sucked into the compressor 20 when refrigerant that includes excessive liquid component flows in. Here, while the vessel 28 appurtenant to the compressor is provided, it is also suitable to additionally deploy in the suction passage 27, an accumulator for preventing liquid flow back to the compressor 20.

The suction injection channel 67 is connected to the suction passage 27 between that portion of the passage 27 connecting the vessel 28 appurtenant to the compressor and the compressor 20. The suction injection channel 67 is a pipe connecting the portion of the branch flow pipe 62 to the downstream side of the heat exchanger for injection 64 as described above, to the suction passage 27. The suction injection switching valve 68 is provided to the suction injection channel 67. The suction injection switching valve 68 is an electromagnetic valve that switches between an open condition and a closed condition.

As described above, the intermediate injection port 23 is provided to the compressor 20. The intermediate injection port 23 is a port for guiding refrigerant from outside into intermediate-pressure refrigerant in the course of compression in the compressor 20. The intermediate injection channel 65 is connected to this intermediate injection port 23. The intermediate injection channel 65 is a pipe connecting the portion of the branch flow pipe 62 to the downstream of the heat exchanger for injection 64 as described above, to the intermediate injection port 23. The intermediate injection switching valve 66 is provided to this intermediate injection channel 65. The intermediate injection switching valve 66 is an electromagnetic valve that switches between an open condition and a closed condition. Note that it is possible to replace the compressor 20 with two compressors in series and connect the intermediate injection channel 65 to the refrigerant piping connecting the discharge port of a low stage compressor and the suction port of a high-stage compressor.

As shown in FIG. 1, the end of the branch flow pipe 62 that passes through the heat exchanger for injection 64 and extends towards the compressor 20, connects, via a bifurcation of the pipe, to the intermediate injection channel 65 and the suction injection channel 67. When the intermediate injection switching valve 66 is in the open condition, the refrigerant that passes through the heat exchanger for injection 64 and flows in the branch flow pipe 62 is injected from the intermediate injection channel 65 to the intermediate injection port 23, and when the suction injection switching valve 68 is in the open condition, the refrigerant flowing in the branch flow pipe 62 is injected from the suction injection channel 67 to the suction passage 27 and sucked into the compressor 20.

Further, the outdoor unit 11 has various sensors, and an outdoor control part 91. The outdoor control part 91 is provided with memory or a microcomputer or the like, for performing control of the outdoor unit 11, and exchanges control signals and the like via the transmission line 93, with the indoor control part 92 of the indoor unit 12. The various sensors include the output pressure sensor, the output temperature sensor 95, the suction temperature sensor and the injection temperature sensor 96 and the like, described above.

(2-3) Refrigerant Communication Pipes

The refrigerant communication pipes 13 and 14 are refrigerant pipes that are installed on site when the outdoor unit 11 and the indoor units 12 are installed on location.

(2-4) Control Part

Figure 2:
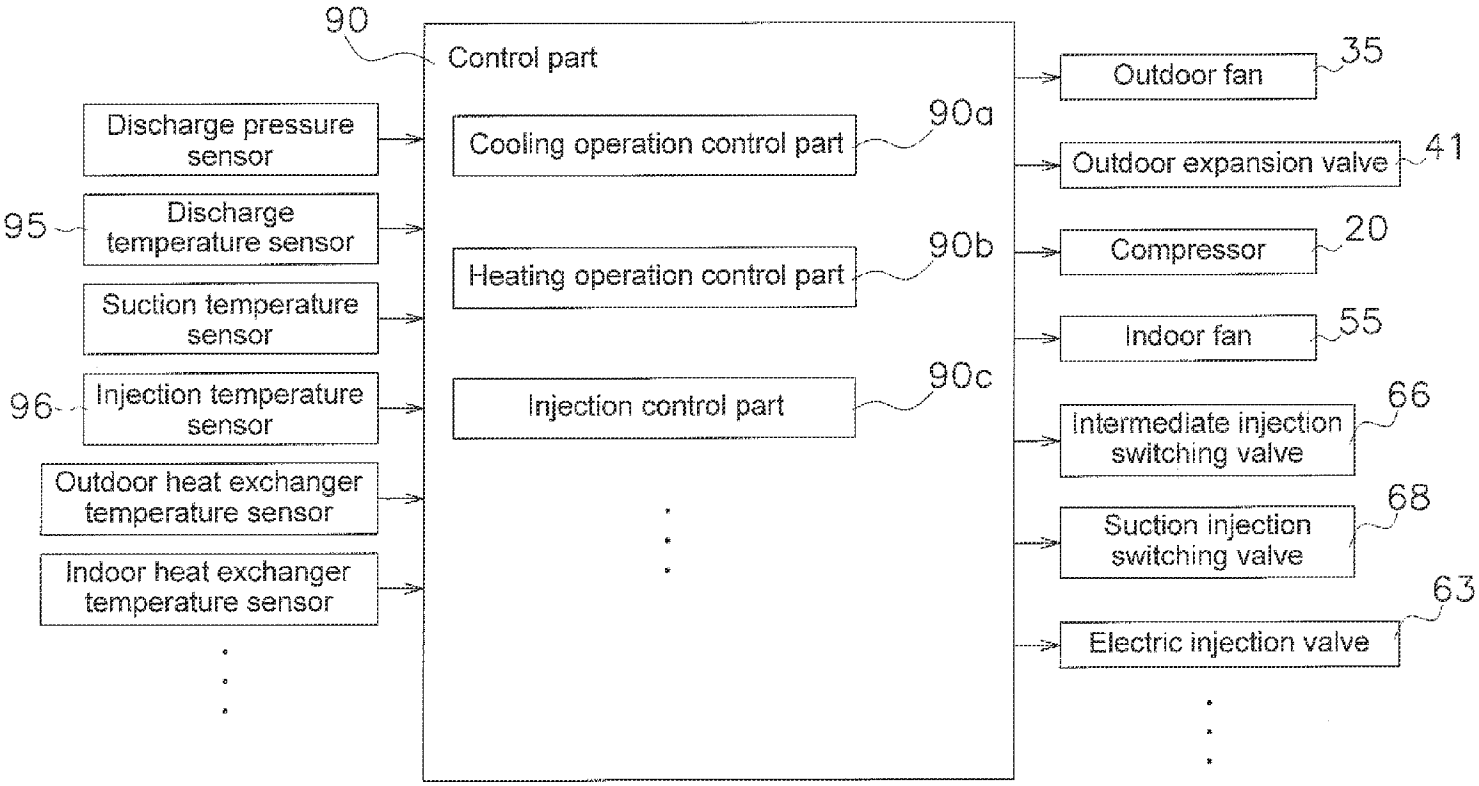
FIG. 2 is a control block diagram for the control part of the air conditioning apparatus.

The control part 90, control device for performing the various operation controls of the air conditioning apparatus 10, comprises the outdoor control part 91 and the indoor control part 92 joined via the transmission line 93 as shown in FIG. 1. As shown in FIG. 2, the control part 90 receives detection signals from the above described various sensors 95, 96, and the like, and implements control of the various devices including the compressor 20, the outdoor fan 35, the expansion valve 41, the indoor fan 55, the electric injection valve 63, the intermediate injection switching valve 66 and the suction injection switching valve 68 and the like based on these detection signals.

The control part 90 is provided with function parts including a cooling operation control part 90*a* that uses the indoor heat exchanger 50 as an evaporator to perform the cooling operation, a heating operation control part 90*b* that uses the indoor heat exchanger 50 as a condenser to perform the heating operation, and an injection control part 90*c* that performs injection control during the cooling operation or the heating operation.

(3) Operation of the Air Conditioning Apparatus

The operation of the air conditioning apparatus 10 according to this embodiment of the present invention will now be described. The controls for each operation explained subsequently are performed from the control part 90 that functions as a means for operation control.

(3-1) Basic Operations for the Cooling Operation

During the cooling operation the four-way switching valve 15 is in the condition indicated by the solid line in FIG. 1, that is, liquid refrigerant discharged from the compressor 20 flows to the outdoor heat exchanger 30, moreover the suction passage 27 is connected to the gas-side shut off valve 18. {{With the outdoor expansion valve 41 fully open, the indoor expansion valve 42 comes to be adjusted}}. Note that the shut off valves 17 and 18 are in the open condition.

With the refrigerant circuit in this condition, the high-pressure gas refrigerant discharged from the compressor 20 is delivered via the four-way switching valve 15 to the outdoor heat exchanger 30 functioning as a condenser of refrigerant, where the refrigerant is cooled by being subjected to heat exchange with outdoor air supplied from the outdoor fan 35. The high-pressure refrigerant cooled in the outdoor heat exchanger 30 and liquefied, becomes refrigerant in a supercooled state at the heat exchanger for injection 64, and is then delivered via the liquid refrigerant communication pipe 13 to each of the indoor units 12. The refrigerant delivered to each of the indoor units 12 is depressurized by the respective indoor expansion valves 42, becoming low-pressure refrigerant in a gas-liquid two-phase state, and is then subjected to heat exchange with indoor air in the indoor heat exchanger 50, functioning as an evaporator of refrigerant, becoming evaporated, low-pressure gas refrigerant. The low-pressure gas refrigerant heated in the indoor heat exchanger 50 is delivered via the gas refrigerant communication pipe 14 to the outdoor unit 11 and sucked into the compressor 20 again via the four-way switching valve 15. This is how the air conditioning apparatus cools indoors.

In the case in which some of the indoor units 12 from among the indoor units 12 are not operating, the indoor expansion valve 42 of the indoor unit 12 that is not operating has the opening closed (for example completely closed). In this case, almost no refrigerant passes through the indoor unit 12 that has stopped operating and the cooling operation is only carried out in the indoor unit 12 that is operating.

(3-2) Basic Operations During the Heating Operation

During the heating operation the four-way switching valve 15 is in the condition indicated by the dashed line in FIG. 1, that is, the discharge-side refrigerant pipe 29 of the compressor 20 is connected to the gas-side shut off valve 18, moreover, the suction passage 27 is connected to the outdoor heat exchanger 30. The outdoor expansion valve 41 and the indoor expansion valve 42 {come to be adjusted}}. Note that the shut off valves 17 and 18 are in the open condition.

With the refrigerant circuit in this condition, the high-pressure gas refrigerant discharged from the compressor 20 is delivered via the four-way switching valve 15 and the gas refrigerant communication pipe 14 to each of the indoor units 12. The high-pressure gas refrigerant delivered to each of the indoor units 12 is cooled by being subjected to heat exchange with indoor air in the respective indoor heat exchangers 50, each functioning as a condenser of refrigerant. Thereafter the refrigerant passes through the indoor expansion valve 42 and is delivered via the liquid refrigerant communication pipe 13 to the outdoor unit 11. As the refrigerant is subjected to heat exchange with indoor air and cooled, the indoor air is heated. The high-pressure refrigerant delivered to the outdoor unit 11 becomes refrigerant in a supercooled state at the heat exchanger for injection 64, and becomes low-pressure refrigerant in a gas liquid two-phase state after depressurization at the outdoor expansion valve 41, which is flowed into the outdoor heat exchanger 30 functioning as an evaporator of refrigerant. The low-pressure refrigerant in a gas-liquid two-phase state flowed into the outdoor heat exchanger 30 is subjected to heat exchange with indoor air supplied from the outdoor fan 35 and heated, becoming evaporated, low-pressure refrigerant. The low-pressure gas refrigerant that has exited from the outdoor heat exchanger 30 is sucked into the compressor 20 again via the four-way switching valve 15. This is how the air conditioning apparatus warms indoors.

(3-3) Injection Control for Each Operation

During the cooling operation and during the heating operation, the injection control part 90*c* that is one of the function parts of the control part 90, performs intermediate injection or suction injection in order to lower the discharge temperature of the compressor 20 or improve operating capacity. Intermediate injection involves diverging a part of the refrigerant flowing in the main refrigerant channel 11*a* from the condenser toward the evaporator, and injecting the refrigerant gas through the intermediate injection channel 65 into the intermediate injection port 23 of the compressor 20. Suction injection involves diverging a part of the refrigerant flowing in the main refrigerant channel 11*a* from the condenser to the evaporator, and injecting the refrigerant gas through the suction injection channel 67 into the suction passage 27, to be sucked into the compressor 20. Both intermediate injection and suction injection have the effect of lowering the discharge temperature of the compressor 20. Intermediate injection has the further effect of raising operating capacity. The injection control part 90*c* implements intermediate injection control that performs intermediate injection or suction injection control that performs suction injection in response to the rotational speed (or the frequency) of the inverter controlled compressor 20, and the discharge temperature Tdi of the refrigerant discharged from the compressor 20 as detected by the discharge temperature sensor 95. In the case that neither of those injection controls is required however, these injection conditions are stopped. That is, the injection control part 90*c* selectively implements a non-injection control in which intermediate injection control, suction injection control, and injection are not implemented at all.

Figure 3:
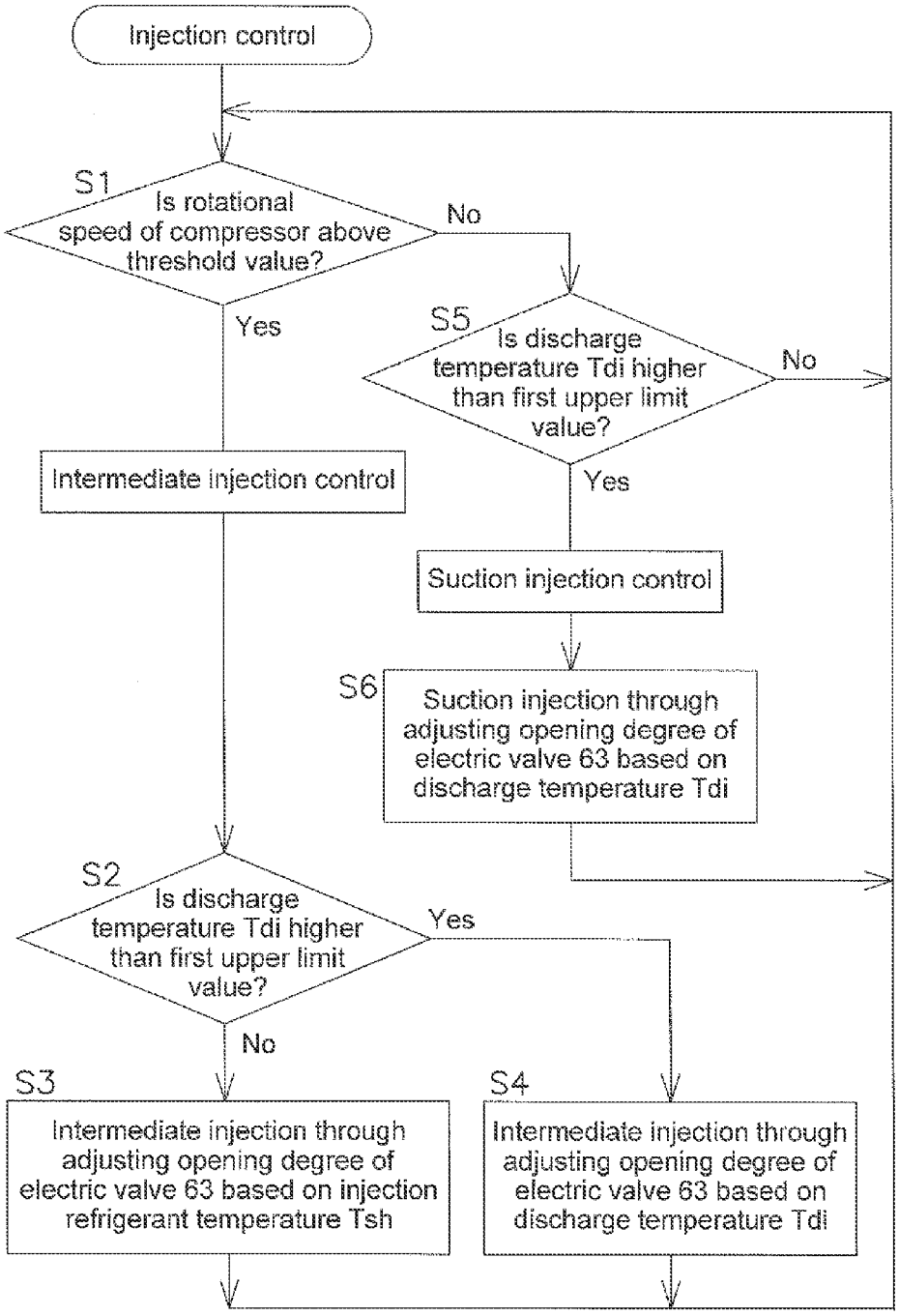
FIG. 3 shows the control flow for injection control.

FIG. 3 shows the control flow for injection control by the injection control part 90*c*. Firstly at step S1, the control part 90*c* determines whether the rotational speed of the compressor 20 is above or below a predetermined threshold. The predetermined threshold is set for example, at a relatively low rotational speed, a value below which a lower rotational speed could not be set, or, a value at which, were the rotational speed to be lowered even further, there would be a decrease in the efficiency of the compressor motor.

If the determination at step S1 is that the rotational speed of the compressor 20 is greater than or equal to the threshold, intermediate injection control is performed. With intermediate injection control, the intermediate injection switching valve 66 is put in the open condition and the suction injection switching valve 68 is put in the closed condition. Then in intermediate injection control, at step S2, the injection control part 90*c* determines whether or not the discharge temperature Tdi of refrigerant discharged from the compressor 20 as detected by the discharge temperature sensor 95, is higher than a first upper limit value. The first upper limit value can be set at for example 95° C. If the discharge temperature Tdi is lower than the first upper limit value, at step S3, the opening degree of the electric injection valve 63 is adjusted based on the temperature Tsh of refrigerant for injection to the downstream side of the heat exchanger for injection 64, as detected by the injection temperature sensor 96. The injection control part 90*c* controls the degree of opening of the electric injection valve 63 such that gas refrigerant for intermediate injection becomes superheated gas, that is, such that gas refrigerant superheated by several degrees Celsius, comes to flow in the intermediate injection channel 65. This improves capacity as appropriate. On the other hand, if at step S2 it is determined that the discharge temperature Tdi is higher than the first upper limit value, at step S4, the degree of opening of the electric injection valve 63 is adjusted based on the discharge temperature Tdi of refrigerant discharged from the compressor 20. Here, moisture control is performed that moistens gas refrigerant to be subject to intermediate injection such that the discharge temperature Tdi is brought below the first upper limit value. That is, the injection control part 90*c* controls the degree of opening of the electric injection valve 63 such that the gas refrigerant for intermediate injection becomes gas-liquid, two-phase flash gas, in order to raise the cooling effect of intermediate injection.

When the rotational speed of the compressor 20 is below the threshold value at step S1, step S5 is transitioned to, and a determination is made whether or not the discharge temperature Tdi of refrigerant discharged from the compressor 20 is higher than the first upper limit value. Here, in the case that the discharge temperature Tdi is lower than the first upper limit value, cooling of the compressor 20 is not required, further as there is no merit in further reducing the rotational speed of the compressor 20, intermediate injection and suction injection are not performed (omitted from the explanation of the flow in FIG. 3). That is, the intermediate injection switching valve 66 and the suction injection switching valve 68 are put in the closed condition. In the case of a determination at step S5 that the discharge temperature Tdi is higher than the first upper limit value, suction injection control is performed. In suction injection control, the intermediate injection switching valve 66 is put in the closed condition and the suction injection switching valve 68 is put in the open condition. Further, the suction injection control at step S6 controls the opening degree of the injection valve 63 based on the discharge temperature Tdi of refrigerant discharged from the compressor 20. Here, moisture control is performed that moistens gas refrigerant to be subject to suction injection such that the discharge temperature Tdi is below the first upper limit value. That is, the injection control part 90*c* controls the degree of opening of the electric injection valve 63 such that the gas refrigerant for suction injection becomes gas-liquid, two-phase flash gas, in order to raise the cooling effect of suction injection.

Note that if the discharge temperature Tdi of the refrigerant discharged from the compressor 20 as detected by the discharge temperature sensor 95 exceeds a second upper limit value that is higher than the first upper limit value, droop control of the compressor 20 commences, forcing a reduction in the rotational speed of the compressor 20, moreover if the detected temperature Tdi exceeds a third upper limit value that is still higher than the second upper limit value, the control part 90 issues an instruction to stop the compressor 20.

(4) Characteristics of the Air Conditioning Apparatus (4-1)

The air conditioning apparatus 10 according to this embodiment, while being provided with the intermediate injection channel 65 and the suction injection channel 67, has the intermediate injection switching valve 66 and the suction injection switching valve 68 provided as switching mechanisms to switch between performing either intermediate or suction injection. In the intermediate injection condition (the condition in which the intermediate injection switching valve 66 is open and the suction injection switching valve 68 is closed) intermediate injection is performed, and in the suction injection condition (the condition in which the intermediate injection switching valve 66 is closed and the suction injection switching valve 68 is open) suction injection is performed. When the injection control part 90*c* of the control part 90 is suppressing the rotational speed of the compressor at low thermal load, such as in the heating operation when the external air temperature is high, and as intermediate injection control is implemented the operating efficiency deteriorates substantially, the injection control part 90*c* performs suction injection control as in step S6 shown in FIG. 3, lowering the discharge temperature of the compressor 20.

Thus, as in the air conditioning apparatus 10 operation is allocated between intermediate injection control and suction injection control, it is possible, while lowering the discharge temperature of the compressor 20 and continuing operating, to maintain operating efficiency.

(4-2)

In the air conditioning apparatus 10 according to this embodiment, refrigerant for injection that comes to flow to the compressor 20 via either the intermediate injection channel 65 or the suction injection channel 67, becomes refrigerant that is depressurized at the electric injection valve 63 provided to the branch flow pipe 62 and subjected to heat exchange at the heat exchanger for injection 64. Thus, controlling the adjustment of the degree of opening of the electric injection valve 63 enables the refrigerant for injection caused to merge with intermediate-pressure refrigerant of the compressor 20 or low-pressure refrigerant that is sucked into the compressor 20, to become superheated gas in accordance with step S3 or flash gas in accordance with step S4 or step S6.

Thus, normally intermediate injection is performed with refrigerant gas superheated at step S3, and when the discharge temperature of the compressor 20 becomes high, it is possible (at step S4) to perform intermediate injection that emphasizes cooling using wet, flash gas in a gas-liquid two-phase state.

(4-3)

With the air conditioning apparatus 10 according to this embodiment it is preferable that, if the discharge temperature Tdi detected by the discharge temperature sensor 95 becomes higher than the first upper limit value that is the threshold value, the temperature of the compressor 20 be lowered using refrigerant for injection flowing in the branch flow pipe 62, in order that the discharge temperature Tdi becomes lower than the first upper limit value.

However, when operating at low thermal load with reduced rotational speed of the compressor 20, such as the heating operation when the external air temperature is high, if intermediate injection control is performed, capacity increases and pressure (high pressure) of refrigerant discharged by the compressor increasing substantially.

In this light, with the air conditioning apparatus 10 according to this embodiment, when the rotational speed of the compressor 20 is below the threshold value (No at step S1), moreover the discharge temperature Tdi detected by the discharge temperature sensor 95 is higher than the first upper limit value (Yes at step S5), even when intermediate injection control has been operating to that point, the switch is made to suction injection control (step S6). Thus, even in the case of low thermal load, while suppressing wasteful capacity increase and maintaining operating efficiency, the discharge temperature Tdi can be reduced through suction injection control.

The reason that intermediate injection control is not performed in the case in which the rotational speed of the compressor 20 is below the threshold value is that, while for example the rotational speed of the compressor 20 can be lowered by performing intermediate injection, further reducing the rotational speed in the case in which rotational speed is already low will result in substantial deterioration in the efficiency of the compressor motor. Further, in this kind of case, if the discharge temperature Tdi of the compressor 20 exceeds the first upper limit value and rises, the compressor 20 may fall into a condition of droop control or stop, thus suction injection is performed. Note that suction injection, while having the advantageous effect of lowering the discharge temperature of the compressor 20 in the same manner as intermediate injection, basically does not have the effect of raising capacity in the way of intermediate injection, thus operating efficiency can be maintained without wasteful capacity increase at times of low thermal load. As the air conditioning apparatus 10 according to this embodiment uses R32 as the refrigerant, if the difference between high-pressure and low-pressure is substantial the difference in enthalpy between high-pressure and low-pressure also becomes substantial, making this injection control that switches to suction injection of good effect.

(4-4)

With the air conditioning apparatus 10 according to this embodiment, using intermediate injection control increases capacity and efficiency, however if the discharge temperature Tdi of the compressor 20 rises up to a level that raises concerns about continuously operating, it becomes necessary to implement droop control that forcefully reduces the rotational speed of the compressor 20 or to stop the compressor 20.

In order to avoid this, with the air conditioning apparatus 10, if the temperature detected by the discharge temperature sensor 95 (discharge temperature Tdi) is higher than the first upper limit value, the degree of opening of the electric injection valve 63 is adjusted (step S4) based on the temperature detected by the discharge temperature sensor 95 and not the temperature detected by the injection temperature sensor 96. Then at step S4, in order that the discharge temperature of the compressor 20 reduces, wet refrigerant gas is used for intermediate injection to the compressor 20, heightening the cooling effect. On the other hand, when the temperature detected by the discharge temperature sensor 95 (discharge temperature Tdi) is lower than the first upper limit value, the degree of opening of the electric injection valve 63 is adjusted (step S3) based on the temperature detected by the injection temperature sensor 96 to the downstream side of the heat exchanger for injection 64, maintaining operating efficiency.

(5) Modifications (5-1) Modification A

The air conditioning apparatus 10 according to the above embodiment employs the two electromagnetic valves, the intermediate injection switching valve 66 and the suction injection switching valve 68, as switching mechanisms for switching between intermediate injection and suction injection, however it is also suitable to instead deploy a three-way valve at the location where the three pipes, i.e., the branch flow pipe 62, the intermediate injection channel 65 and the suction injection channel 67 intersect.

(5-2) Modification B

Figure 4:
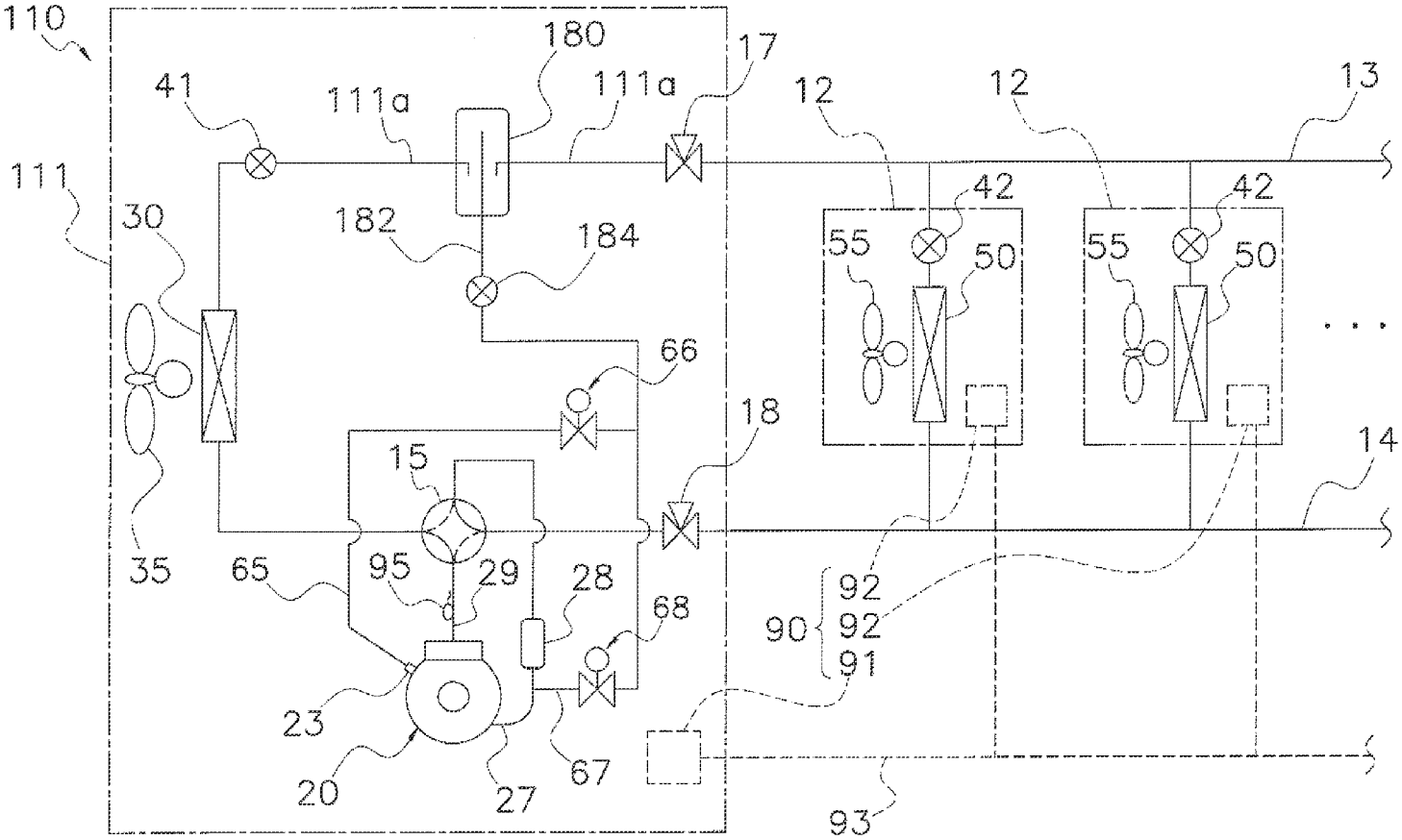
FIG. 4 shows the refrigerant piping system of an air conditioning apparatus according to modification B.

The air conditioning apparatus 10 according to the above embodiment employs a configuration in which refrigerant for injection is supplied from the branch flow pipe 62 branched from the main refrigerant channel 11*a* to the intermediate injection channel 65 or the suction injection channel 67. It is also possible however to adopt a configuration as shown in FIG. 4, in which the gas component of refrigerant accumulated in a high-pressure receiver 180 provided to a main refrigerant channel 11*a* is taken out at a bypass channel 182, and refrigerant for injection is supplied from that bypass channel 182 to the intermediate injection channel 65 or the suction injection channel 67.

The air conditioning apparatus 110 according to modification B replaces the outdoor unit 11 of the air conditioning apparatus 10 of the above described embodiment with the outdoor unit 111. The outdoor unit 111 does not include the bridge circuit 70, the high-pressure receiver 80, the branch flow pipe 62, the electric injection valve 63 and the heat exchanger for injection 64 of the outdoor unit 11, being instead provided with a high-pressure receiver 180, the bypass channel 182 and an electronic bypass valve for injection 184. Those elements in the outdoor unit 111 that have the same reference numerals as those of the outdoor unit 11 are substantially the same as those elements in the above described embodiment and their description is omitted.

The high-pressure receiver 180 is a vessel provided to part of the main refrigerant channel 111*a* connecting the outdoor expansion valve 41 and the liquid-side shut off valve 17. The main refrigerant channel 11*a* is the main channel for liquid refrigerant and connects the outdoor heat exchanger 30 and the indoor heat exchanger 50. The high-pressure receiver 180 into which high-pressure refrigerant flows during the cooling operation and during the heating operation, is not subject to the adverse phenomena in which, as the surplus refrigerant accumulated at the bottom is maintained at a comparatively high temperature, the surplus refrigerant including refrigerator oil separates into two layers with the refrigerator oil accumulating at the top. Normally liquid refrigerant comes to reside in the lower part of the space inside the high-pressure receiver 180 and the gas refrigerant comes to reside in the upper part of that space. The bypass channel 182 extends from the upper part of that internal space toward the compressor 20. The bypass channel 182 is a pipe that fulfills the role of guiding the gas component of the refrigerant accumulated inside the high-pressure receiver 180 to the compressor 20. An electronic bypass valve for injection 184 having an adjustable opening, is installed to the bypass channel 182. By opening this electronic bypass valve for injection 184 intermediate injection is performed during the intermediate injection condition (the condition in which the intermediate injection switching valve 66 is open and the suction injection switching valve 68 is closed), and suction injection is performed during the suction injection condition (the condition in which the intermediate injection switching valve 66 is closed and the suction injection switching valve 68 is open).

With this air conditioning apparatus 110 according to modification B, the refrigerant that comes to flow via the intermediate injection channel 65 or the suction injection channel 67 to the compressor 20 becomes the gas component of the refrigerant that accumulates inside the high-pressure receiver 180. That is, saturated gas of the refrigerant in the high-pressure receiver 180 comes to flow to the compressor 20. With the air conditioning apparatus 110, in addition to the capability of splitting usage between intermediate injection control and suction injection control in the same manner as the air conditioning apparatus 10 according to the above described embodiment, the heat exchanger for injection 64 of that above described embodiment is rendered unnecessary, thus holding down the production cost of the air conditioning apparatus 110. On the other hand, the air conditioning apparatus 110 does not enable injection of wet gas, and as the injection basically uses saturated gas, control that raises the cooling effect of injection (control such as that in step S4 of the above described embodiment) cannot be performed.

Second Embodiment

The air conditioning apparatus 10 according to the first embodiment described above adopts a configuration in which refrigerant for injection is supplied from the branch flow pipe 62 branched from the main refrigerant channel 11*a*, to the intermediate injection channel 65 or the suction injection channel 67. Further, the air conditioning apparatus 110 of modification B of the first embodiment adopts a configuration in which the gas component of refrigerant accumulated in the high-pressure receiver 180 provided to the main refrigerant channel 11*a* is taken out at a bypass channel 182, and refrigerant for injection is supplied from that bypass channel 182 to the intermediate injection channel 65 or the suction injection channel 67. It is possible instead of this configuration however, to configure the air conditioning apparatus so as to enable selection of injection from the branch flow pipe 262 and injection from the bypass channel 282 extending from the receiver 280.

(1) Configuration of the Air Conditioning Apparatus

Figure 5:
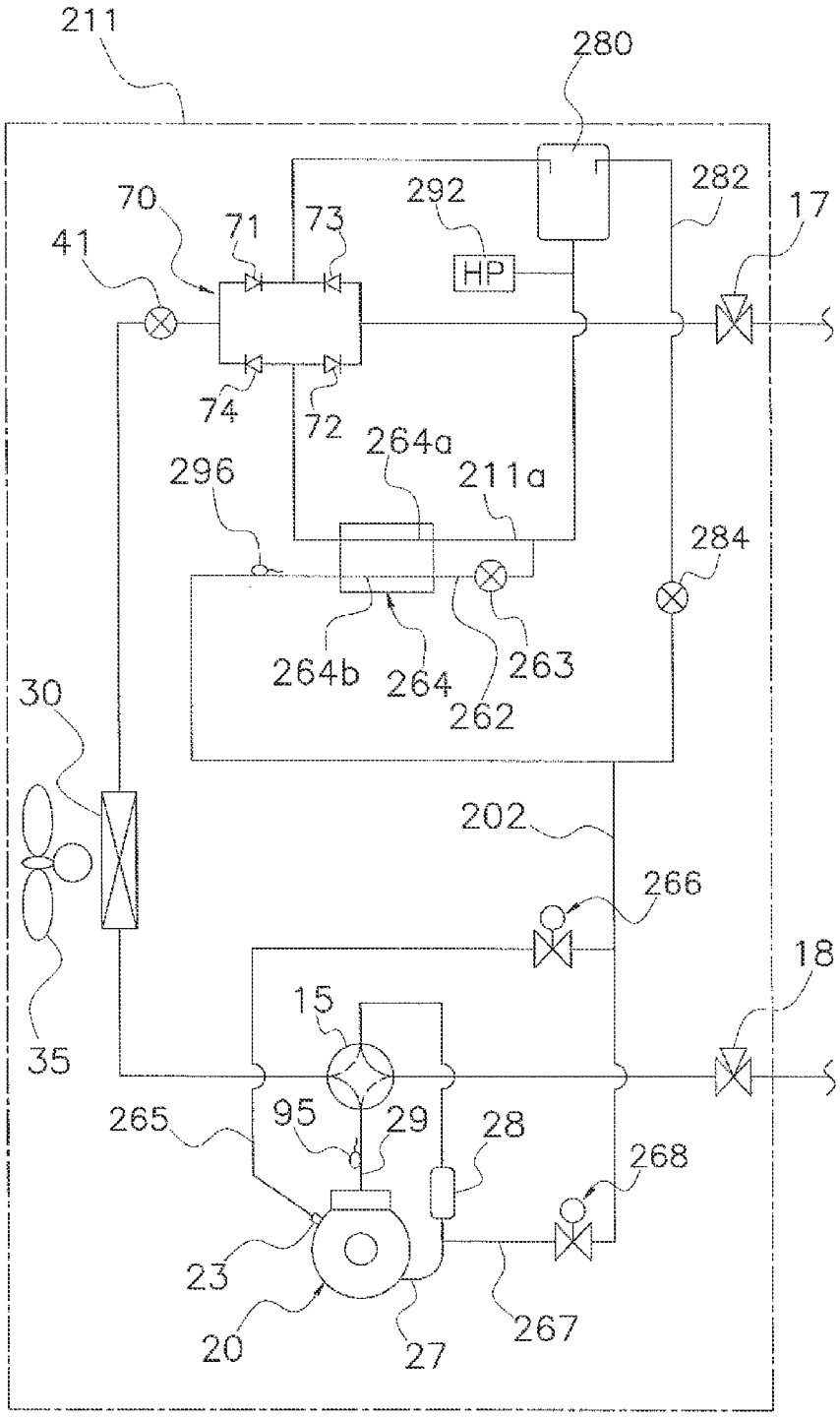
FIG. 5 shows the refrigerant piping system of an air conditioning apparatus according to a second embodiment of the present invention.
Figure 6A:
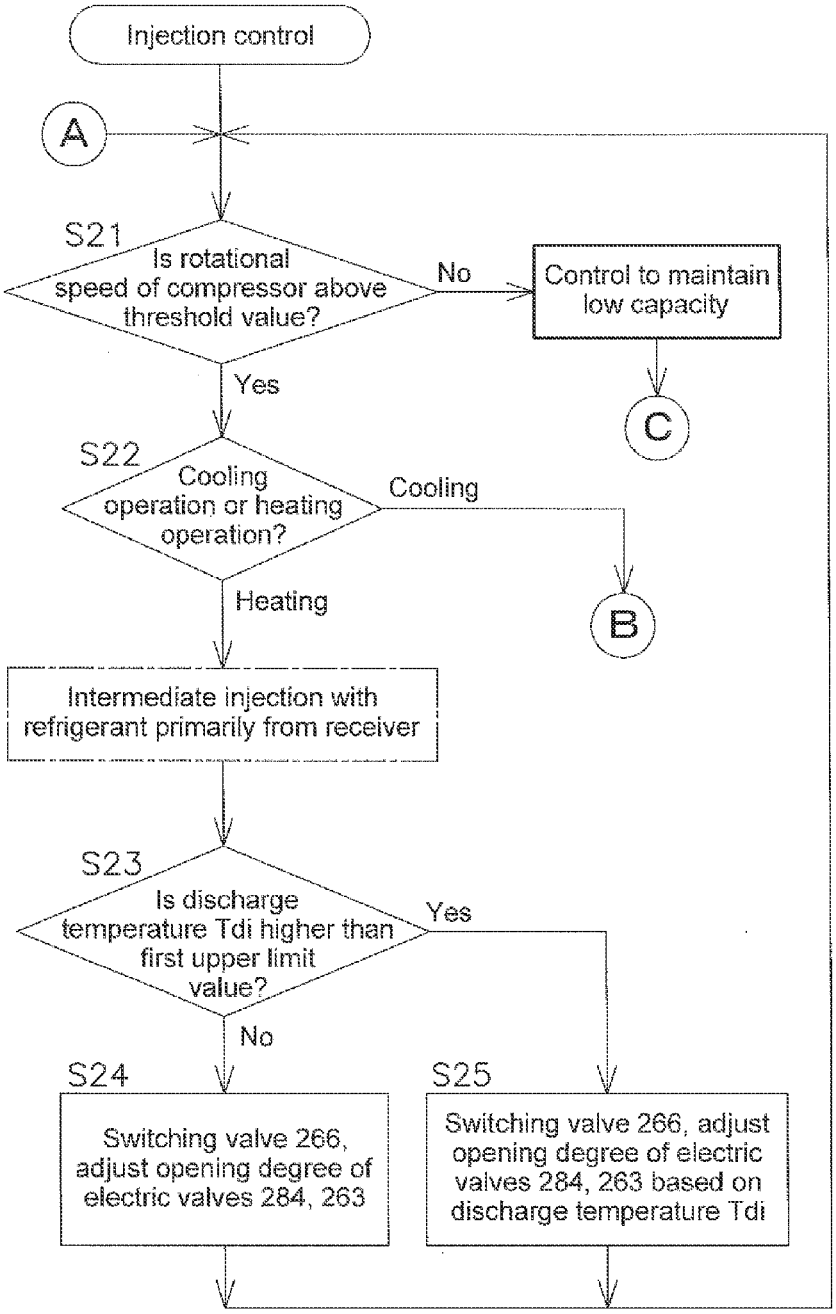
FIG. 6A shows the injection control flow of the air conditioning apparatus according to the second embodiment.
Figure 6B:
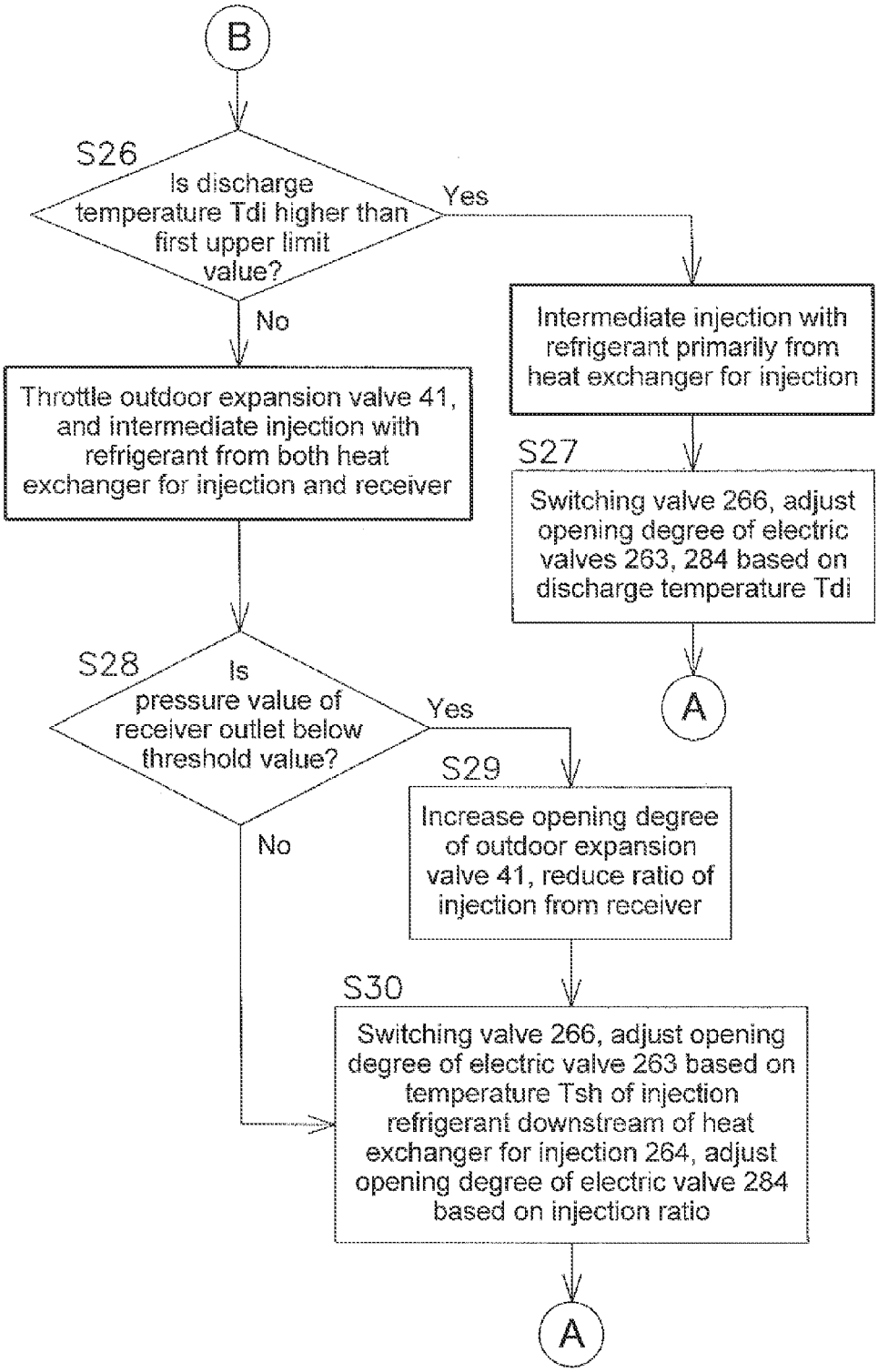
FIG. 6B shows the injection control flow of the air conditioning apparatus according to the second embodiment.
Figure 6C:
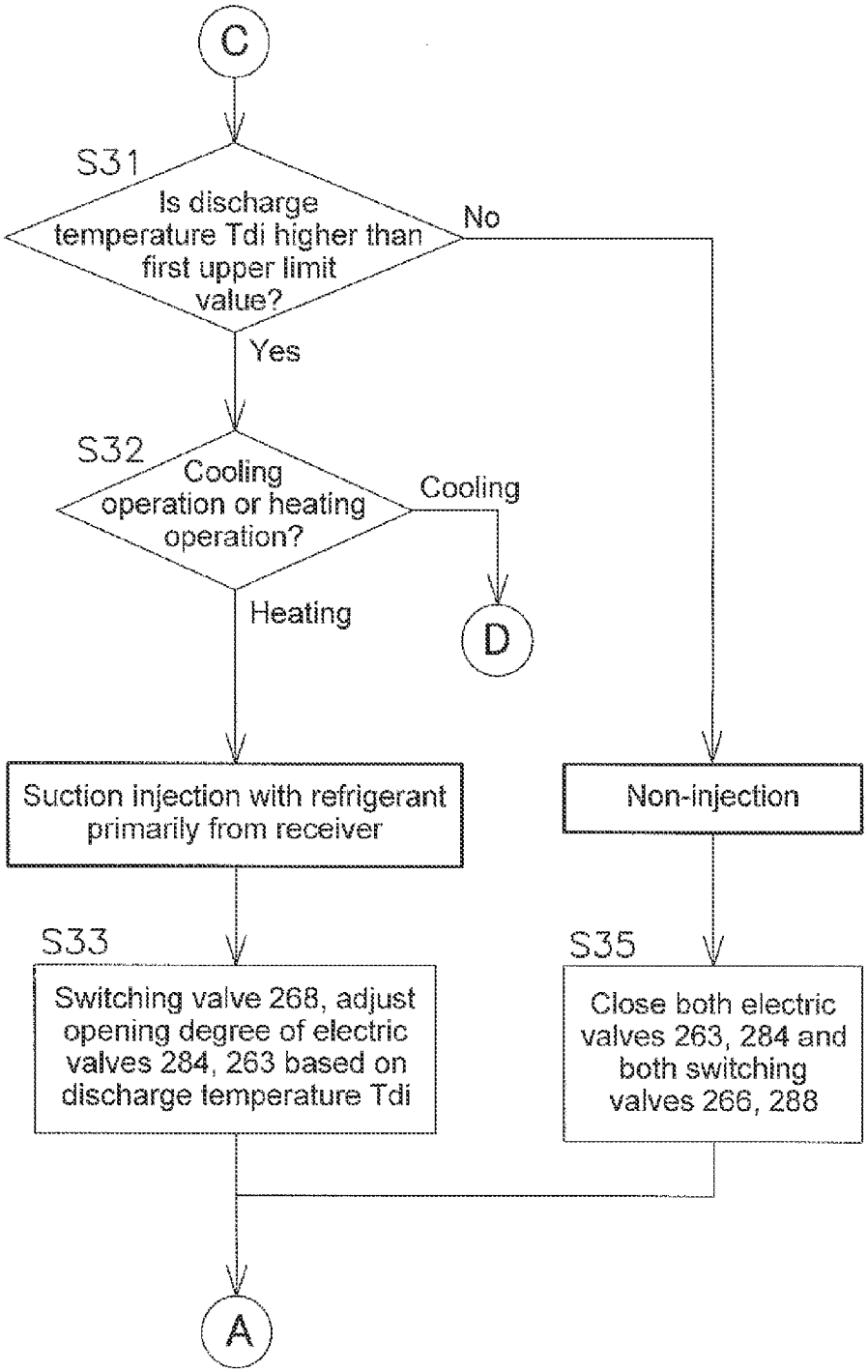
FIG. 6C shows the injection control flow of the air conditioning apparatus according to the second embodiment.
Figure 6D:
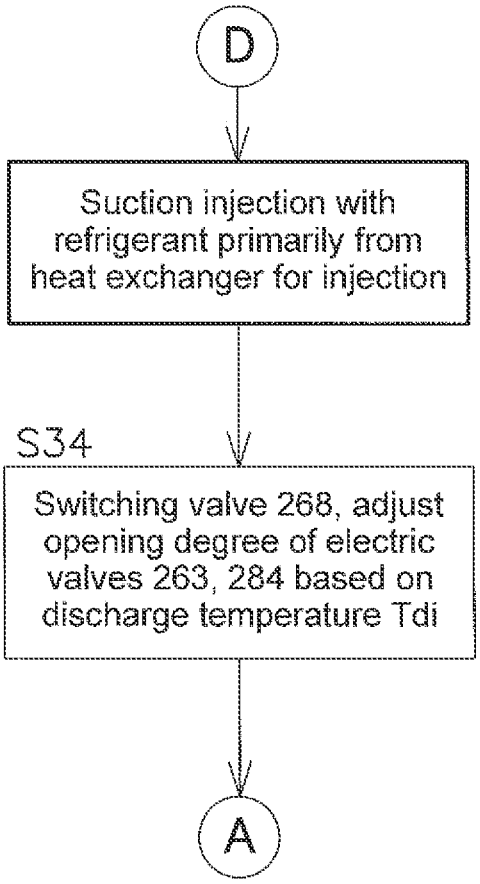
FIG. 6D shows the injection control flow of the air conditioning apparatus according to the second embodiment.

The air conditioning apparatus according to the second embodiment replaces the outdoor unit 11 of the air conditioning apparatus 10 of the first embodiment described above using R32 as refrigerant with an outdoor unit 211 as shown in FIG. 5. The outdoor unit 211 will now be described, the same reference numerals being applied for those elements that are the same as those in the outdoor unit 11 of the first embodiment.

The outdoor unit 211 has primarily, the compressor 20, the four way switching valve 15, an outdoor heat exchanger 30, an outdoor expansion valve 41, the bridge circuit 70, a high-pressure receiver 280, a first electronic injection valve 263, an heat exchanger for injection 264, a second electronic injection valve 284, an intermediate electronic injection valve 266, a suction electronic injection valve 268, the liquid-side shut off valve 17 and the gas-side shut off valve 18.

The compressor 20, the vessel 28 appurtenant to the compressor, the suction passage 27, the refrigerant pipe 29 at the discharge side of the compressor 20, the discharge temperature sensor 95, the intermediate injection port 23, the four-way switching valve 15, the liquid-side shut off valve 17, the gas-side shut off valve 18, the outdoor heat exchanger 30, the outdoor expansion valve 41, the outdoor fan 35 and the bridge circuit 70 are the same as the corresponding elements in the first embodiment, therefore their description is omitted.

The high-pressure receiver 280 is a vessel that functions as a refrigerant storage tank, and is disposed between the outdoor expansion valve 41 and the liquid-side shut off valve 17. The high-pressure receiver 280, into which high-pressure refrigerant flows during the cooling operation and during the heating operation, does not have the problem in which the excess refrigerant including refrigerant oil separates into two layers, with the refrigerant oil collecting in the upper portion, as the temperature of excess refrigerant accumulated therein is maintained relatively high. A receiver outlet pressure sensor 292 is provided to the receiver outlet pipe that extends from the lower portion of the high-pressure receiver 280 to the heat exchanger for injection 264. The receiver outlet pipe is part of the main refrigerant channel 211*a* described subsequently. The receiver outlet pressure sensor 292 is a sensor that outputs a pressure value (high-pressure value) for high-pressure liquid refrigerant.

Liquid refrigerant normally resides in the lower part of the internal space of the high-pressure receiver 280, and gas refrigerant normally resides in the upper part of that space, while a bypass channel 282 extends from that upper part of the internal space toward the compressor 20. The bypass channel 282 is a pipe that plays the role of guiding the gas component of refrigerant accumulated inside the high-pressure receiver 280 to the compressor 20. A second bypass electronic injection valve 284 having an adjustable opening, is provided to the bypass channel 282. When this second bypass electronic injection valve 284 opens, gas refrigerant flows via a common injection tube 202 to an intermediate injection channel 265 or a suction injection channel 267 described subsequently.

A heat exchanger for injection 264 is provided between the outlet check valves 72 and 74 of the bridge circuit 70 and the outlet of the high-pressure receiver 280. Further, a branch flow pipe 262 branches from a part of the main refrigerant channel 211*a* that connects the outlet of the high-pressure receiver 280 and the heat exchanger for injection 264. The main refrigerant channel 211*a* is the main channel for liquid refrigerant, and connects the outdoor heat exchanger 30 and the indoor heat exchanger 50.

The first electronic injection valve 263, having an adjustable opening, is provided to the branch flow pipe 262. The branch flow pipe 262 is attached to a second flow path 264*b* of the heat exchanger for injection 264. That is, when the first electronic injection valve 263 is open, refrigerant diverged from the main refrigerant channel 211*a* to the branch flow pipe 262 is depressurized at the first electronic injection valve 263 and flows to the second flow path 264*b* of the heat exchanger for injection 264.

The refrigerant depressurized at the first electronic injection valve 263 and flowed to the second flow path 264*b* of the heat exchanger for injection 264 is subject to heat exchange with refrigerant flowing in a first flow path 264*a* of the heat exchanger for injection 264. The refrigerant that flows through the branch flow pipe 262 after heat exchange at the heat exchanger for injection 264, flows via the shared injection tube 202 and into the intermediate injection channel 265 or the suction injection channel 267 described subsequently. An injection temperature sensor 296 for detecting the temperature of refrigerant after heat exchange at the heat exchanger for injection 264, is mounted to the down flow side of the heat exchanger for injection 264 of the branch flow pipe 262.

The heat exchanger for injection 264 is an internal heat exchanger employing a double tube structure. One end of the first flow path 264*a* connects to the outlet of the high-pressure receiver 280, and the other end connects to the outlet check valves 72 and 74 of the bridge circuit 70.

The common injection tube 202 is a pipe connecting to an end of the bypass channel 282 extending from the high-pressure receiver 280 and an end of the branch flow pipe 262 extending from the main refrigerant channel 211*a* via the heat exchanger for injection 264, and connecting to the intermediate electronic injection valve 266 and the suction electronic injection valve 268. If at least one from among the first electronic injection valve 263 and the second bypass electronic injection valve 284 is open, and either the intermediate electronic injection valve 266 or the suction electronic injection valve 268 opens, refrigerant flows in the common injection tube 202, and intermediate injection or suction injection is implemented.

The intermediate injection channel 265 extends from the intermediate electronic injection valve 266 connected to the common injection tube 202, to the compressor 20. Basically, one end of the intermediate injection channel 265 is connected to the intermediate electronic injection valve 266, and the other end is connected to the intermediate injection port 23 of the compressor 20.

The suction injection channel 267 extends from the suction electronic injection valve 268 connected to the common injection tube 202 to the suction passage 27. Basically, one end of the suction injection channel 267 is connected to the suction electronic injection valve 268, and the other end is connected to the part of the suction passage 27 connecting the vessel 28 and the compressor 20.

The intermediate electronic injection valve 266 and the suction electronic injection valve 268 are solenoid valves that switch between an open condition and a closed condition.

(2) Operation of the Air Conditioning Apparatus

The operation of the air conditioning apparatus according to the second embodiment of the present invention will now be described. The controls for each operation explained subsequently are performed by the control part of the outdoor unit 211 that functions as a means for operation control.

(2-1) Basic Operations for the Cooling Operation

During the cooling operation the four-way switching valve 15 is in the condition indicated by the solid line in FIG. 5, that is, gas refrigerant discharged from the compressor 20 flows to the outdoor heat exchanger 30, moreover the suction passage 27 is connected to the gas-side shut off valve 18. {With the outdoor expansion valve 41 in the fully open condition, the degree of opening of the indoor expansion valve 42 comes to be adjusted.} Note that the shut off valves 17 and 18 are in the open condition.

With the refrigerant circuit in this condition, the high-pressure gas refrigerant discharged from the compressor 20 is delivered via the four-way switching valve 15 to the outdoor heat exchanger 30 functioning as a condenser of refrigerant, where the refrigerant is cooled by being subjected to heat exchange with outdoor air supplied from the outdoor fan 35. The high-pressure refrigerant cooled in the outdoor heat exchanger 30 and liquefied, becomes refrigerant in a supercooled state at the heat exchanger for injection 264, and is then delivered to each of the indoor units 12. The operation of each of the indoor units 12 is the same as in the first embodiment described above. Low-pressure gas refrigerant returning to the outdoor unit 11 from each of the indoor units 12 is sucked into the condenser 20 again, via the four-way switching valve 15. Basically, this is how the air conditioning apparatus cools indoors.

(2-2) Basic Operations for the Heating Operation

During the heating operation the four-way switching valve 15 is in the condition shown by the dashed line in FIG. 5, that is the discharge-side refrigerant pipe 29 of the compressor 20 is connected to the gas-side shut off valve 18, moreover the suction passage 27 is connected to the outdoor heat exchanger 30. The degrees of opening of the outdoor expansion valve 41 and the indoor expansion valve 42 {{come to be adjusted.?}}

With the refrigerant circuit in this condition, high-pressure gas refrigerant discharged from the compressor 20 passes via the four-way switching valve 15 and the gas refrigerant communication pipe 14 and is delivered to each of the indoor units 12. The operation of each of the indoor units 12 is the same as for the first embodiment described above. The high-pressure refrigerant returning to the outdoor unit 11 again, passes via the high-pressure receiver 280 and becomes refrigerant in a supercooled state at the heat exchanger for injection 264, before flowing to the outdoor expansion valve 41. The refrigerant depressurized at the outdoor expansion valve 41 and now low-pressure refrigerant in a gas-liquid two-phase state, flows into the outdoor heat exchanger 30 functioning as an evaporator. The low-pressure, gas-liquid two-phase state refrigerant that flows into the outdoor heat exchanger 30 is heated by being subject to heat exchange with outdoor air supplied from the outdoor fan 35, and is evaporated, becoming low-pressure refrigerant. The low-pressure gas refrigerant coming out of the outdoor heat exchanger 30 passes via the four-way switching valve 15 and is sucked into the compressor 20 again. Basically, this is how the air conditioning apparatus heats indoors.

(2-3) Injection Control for Each Operation

During the cooling operation and during the heating operation, the control part performs intermediate injection or suction injection, the object being to improve operating capacity or decrease the discharge temperature of the compressor 20. Intermediate injection means that the refrigerant that has flowed into the common injection tube 202 from the heat exchanger for injection 264 and/or the high-pressure receiver 280, flows through the intermediate injection channel 265 and is injected into the intermediate injection port 23 of the compressor 20. Suction injection means that the refrigerant that has flowed into the common injection tube 202 from the heat exchanger for injection 264 and/or the high-pressure receiver 280, is injected into the suction passage 27 by way of the suction injection channel 267 and caused to be sucked into the compressor 20. Both intermediate injection and suction injection have the effect of decreasing the discharge temperature of the compressor 20. Intermediate injection has the further effect of improving operating capacity.

The control part performs injection control based on the rotational speed (or the frequency) of the inverter controlled compressor 20, the discharge temperature Tdi of refrigerant discharged from the compressor 20 as detected by the discharge temperature sensor 95, and the temperature of injected refrigerant as detected by the injection temperature sensor 296 to the downstream side of the heat exchanger for injection 264. Basically, the control part implements intermediate injection control that causes intermediate injection, or implements suction injection control that causes suction injection. Further, when the conditions are such that the control part should not perform either intermediate injection or suction injection, neither form of injection is performed and operations are carried out in the non-injection condition. In other words, the control part may selectively perform intermediate injection control, suction injection control, or non-injection control in which no injection is implemented.

The flow of injection control from the control part will now be described with reference to FIG. 6A through FIG. 6D.

Firstly, at step S21, the control part determines whether the rotational speed of the compressor 20 is above or below a predetermined threshold. The predetermined threshold is set for example, at a relatively low rotational speed, a value below which a lower rotational speed could not be set, or, a value at which, were the rotational speed to be lowered even further, there would be a decrease in the efficiency of the compressor motor.

(2-3-1) Intermediate Injection Control

If the control part determines at step S21 that the rotational speed of the compressor 20 is greater than or equal to the threshold, the control part transitions to step S22 to determine whether the air conditioning apparatus is performing the cooling operation or the heating operation. In the case of the cooling operation, intermediate injection is performed, that flows gas refrigerant taken from primarily the high-pressure receiver 280, to the intermediate injection channel 265.

(2-3-1-1) Intermediate Injection Control During Heating

If the determination at step S22 is that the air conditioning apparatus is in the heating operation, the control part transitions to step S23 and determines whether or not the discharge temperature Tdi of refrigerant discharged from the compressor 20 as detected by the discharge temperature sensor 93, is higher than the first upper limit value. The first upper limit value can be set at for example 95° C. If the discharge temperature is not higher than the first upper limit value, the control part transitions to step S24 and puts the intermediate electronic injection valve 266 into the open condition and the suction electronic injection valve 268 into the closed condition. If those valves are already in those respective conditions, the valves are maintained as they are. Further, at step S24 the respective degrees of opening of the first electronic injection valve 263 and the second electronic injection valve 284 are adjusted. As the discharge temperature Tdi is in the normal range, the opening of the first electronic injection valve 263 is adjusted, in accordance with basic heating operation control, such that liquid refrigerant out from the high-pressure receiver 280 and flowing in the main refrigerant channel 211*a* reaches a predetermined degree of supercooling. Moreover, the opening of the second electronic injection valve 284 is adjusted such that the gas refrigerant in the high-pressure receiver 280, flows to the intermediate injection channel 265. On the other hand, if, at step S23, the control part determines that the discharge temperature Tdi is higher than the first upper limit value, step S25 is transitioned to. Here, as it is necessary to reduce the discharge temperature Tdi, the respective openings of the first electronic injection valve 263 and the second electronic injection valve 284 are adjusted based on that discharge temperature Tdi. Basically, at step S25, moisture control is performed that moistens gas refrigerant to be subject to intermediate injection such that the discharge temperature Tdi can be swiftly brought below the first upper limit value. That is, in order to raise the cooling effect of intermediate injection, the opening of the first electronic injection valve 263 and the like is adjusted such that gas refrigerant for intermediate injection becomes gas-liquid, two-phase flash gas.

(2-3-1-2) Intermediate Injection Control During the Cooling

If the determination at step S22 is that the air conditioning apparatus is in the cooling operation, the control part transitions to step S26 and determines whether or not the discharge temperature Tdi is higher than the first upper limit value. If the discharge temperature Tdi is higher than the first upper limit value, the control part transitions to step S27, and in order to perform moisture control that moistens gas refrigerant to be subject to intermediate injection, refrigerant flows from primarily the heat exchanger for injection 264 to the intermediate injection channel 265. Basically, at step S27, the {{266 is put into the open condition and the suction electronic injection valve 268 is put into the closed condition}, further, the degree of opening of the first electronic injection valve 263 is controlled based on the discharge temperature Tdi. Moreover, at step S27, the second electronic injection valve 284 is opened as required. As at this step S27, wet refrigerant gas in a gas-liquid two-phase state from the heat exchanger for injection 264 is subject to intermediate injection to the compressor 20, the elevated discharge temperature Tdi can be expected to decrease rapidly.

At step S26, if the discharge temperature Tdi is lower than the first upper limit value the control part determines there is no necessity to lower the discharge temperature Tdi, and intermediate injection is performed using both refrigerant from the high-pressure receiver 280 and refrigerant from the heat exchanger for injection 264. Basically, the system transitions via step S28 or step S29 to step S30, the intermediate electronic injection valve 266 is put into the open condition, the suction electronic injection valve 268 is put into the closed condition, moreover the degree of opening of the first electronic injection valve 263 and the degree of opening of the second electronic injection valve 284 are adjusted. At step S28 the control part determines whether or not a high-pressure value of liquid refrigerant detected by the receiver outlet pressure sensor 292 at the outlet of the high-pressure receiver 280 is below a threshold value. This threshold value is an initially set value, based on for example the elevational difference (difference in the height of their respective places of installation) between the outdoor unit 211 and the indoor unit 12, and is set such that if the high-pressure value is lower than this threshold value, prior to passing through the indoor expansion valve 42 of the indoor unit 12, the refrigerant would become refrigerant in a flash gas state and the sound of passing refrigerant would increase substantially. If it is determined at step S28 that the high-pressure value is below the threshold value, as it is necessary to increase the high-pressure value, the outdoor expansion valve 41 in a state of being slightly constricted, is opened more, relieving the degree of depressurization. Thus, the gas component of refrigerant in the high-pressure receiver 280 is reduced, the quantity of gas refrigerant from the high-pressure receiver 280 comprising the total quantity of refrigerant for injection decreases, and the ratio of injection from the high-pressure receiver 280 becomes smaller. On the other hand, if at step S28 the high-pressure value exceeds the threshold value, the system transitions to step S30 maintaining that injection ratio. At step S30, in the same manner as above the intermediate electronic injection valve 266 is open, and both refrigerant flowing from the high-pressure receiver 280 and refrigerant flowing from the heat exchanger for injection 264 flow from the intermediate injection channel 265 to the intermediate injection port 23 of the compressor 20. Moreover at step S30 the degree of opening of the first electronic injection valve 263 is adjusted based on the temperature Tsh of refrigerant used for injection at the down flow side of the heat exchanger for injection 64, further, based on the injection ratio, the opening of the second electronic injection valve 284 is adjusted in conjunction with the degree of opening of the outdoor expansion valve 41.

(2-3-2) Control to Maintain Low Capacity

From S22 up to step S30 above, relates to control when it is determined at step S21 that the rotational speed of the compressor 20 is greater than or equal to the threshold value, however as there is room to drop the rotational speed of the compressor 20 further lowering capacity, basically this control provides improvement in operating capacity through injection.

However, if at step S21 it is determined that the rotational speed of the compressor 20 is less than the threshold value, this means that the compressor 20 has already dropped to low capacity, and as raising the operating capacity right up would be contrary to the needs of users, control is implemented to maintain the capacity of the compressor 20 as it is, in that low capacity condition.

(2-3-2-1) Suction Injection Control

If at step S21 it is determined that the rotational speed of the compressor 20 is below the threshold value, the control part transitions to step S31 and the determination is made whether or not the discharge temperature Tdi is higher than the first upper limit value. If the discharge temperature Tdi is higher than the first upper limit value, as there is no need to lower the discharge temperature Tdi, step S33 or step S34 is transitioned to, and suction injection is implemented.

(2-3-2-1-1) Suction Injection Control During the Heating Operation

If it is determined at step S31 that the discharge temperature Tdi is higher than the first upper limit value, moreover at step S32 it is determined that the heating operation is being performed, suction injection is performed in which primarily refrigerant from the high-pressure receiver 280 flows from the suction injection channel 267 to the suction passage 27. Basically, at step S33, the intermediate electronic injection valve 266 is put into the closed condition and the suction electronic injection valve 268 is put into the open condition. Then, based on the discharge temperature Tdi, the degree of opening of the second electronic injection valve 284 is adjusted such that gas refrigerant accumulated in the high-pressure receiver 280 in the heating operation flows mostly to the suction injection channel 267, further, the degree of opening of the first electronic injection valve 263 is adjusted such that refrigerant flowing from the heat exchanger for injection 264 to the suction injection channel 267 becomes flash gas.

(2-3-2-1-2) Suction Injection Control During the Cooling Operation

If it is determined at step S31 that the discharge temperature Tdi is higher than the first upper limit value, moreover at step S32 it is determined that the cooling operation is being performed, suction injection is performed in which primarily refrigerant from the heat exchanger for injection 264 flows to the suction injection channel 267. Basically, at step S34, the intermediate electronic injection valve 266 is put into the closed condition and the suction electronic injection valve 268 is put into the open condition. Then, based on the discharge temperature Tdi, the degree of opening of the first electronic injection valve 263 is adjusted such that refrigerant flowing from the heat exchanger for injection 264 to the suction injection channel 267 becomes flash gas. Further at step S34, the second electronic injection valve 284 is opened as necessary.

(2-3-2-2) Non-Injection Control

If at step S31 the discharge temperature Tdi is lower than the first upper limit value, it is determined that it is not necessary to reduce the discharge temperature Tdi, and the control part selects the non-injection condition. That is, intermediate injection and suction injection in order to lower the discharge temperature Tdi and intermediate injection in order to improve operation capacity are not required, and as it is desirable to stop those forms of injection, the non-injection condition is implemented. At step S35, the control part puts the intermediate electronic injection valve 266 and the suction electronic injection valve 268 into the closed condition, and adjusts the degree of opening up the first electronic injection valve 263 and the degree of opening of the second electronic injection valve 284 to the minimum. When the minimum degree of opening is zero, the first electronic injection valve 263 and the second electronic injection valve 284 are in the completely closed condition.

Thus, in the air conditioning apparatus according to this second embodiment of the present invention, it is not necessary to lower the {{discharge}}temperature of the compressor 20 by intermediate injection or suction injection as the discharge temperature Tdi is low, moreover, in the case in which the rotational speed of the compressor 20 is decreased as low capacity is required, the non-injection control is selected and implemented. Thus, increase of capacity through intermediate injection or suction injection and the occurrence of decreased operating efficiency are suppressed, and in this air conditioning apparatus according to the second embodiment it is possible to maintain operating efficiency while satisfying the requirement of low capacity.

What is claimed is:

1. A refrigeration apparatus that uses R32 as the refrigerant, the refrigeration apparatus comprising:

a compressor arranged and configured to suck in low-pressure refrigerant from a suction passage, to compress the refrigerant and to discharge high-pressure refrigerant;

a condenser arranged and configured to condense the high-pressure refrigerant discharged from the compressor;

an expansion mechanism arranged and configured to expand the high-pressure refrigerant exiting the condenser;

an evaporator arranged and configured to evaporate the refrigerant expanded by the expansion mechanism;

an intermediate injection channel arranged and configured to guide a part of the refrigerant flowing from the condenser toward the evaporator to the compressor, causing the refrigerant to merge with intermediate-pressure refrigerant of the compressor, a suction injection channel arranged and configured to guide a part of the refrigerant flowing from the condenser toward the evaporator to the suction passage, causing the refrigerant to merge with low-pressure refrigerant sucked into the compressor;

a switching mechanism arranged and configured to switch between an intermediate injection condition in which refrigerant flows in the intermediate injection channel, and a suction injection condition in which refrigerant flows in the suction injection channel;

a discharge temperature sensor arranged and configured to detect temperature of the refrigerant discharged from the compressor; and a control part selectively implementing intermediate injection control in which the intermediate injection condition of the switching mechanism is selected, or suction injection control in which the suction injection condition of the switching mechanism is selected, the control part performing the suction injection control when the discharge temperature detected by the discharge temperature sensor is higher than a temperature threshold value, and a rotational speed of the compressor is below a rotational speed threshold value.

2. The refrigeration apparatus according to claim 1, further comprising a branch flow channel branching from a main refrigerant channel joining the condenser and the evaporator;

an opening adjustable valve provided along the branch flow channel; and an injection heat exchanger arranged and configured to exchange heat between the refrigerant flowing in the main refrigerant channel and the refrigerant flowing downstream of the opening adjustable valve in the branch flow channel, the refrigerant exiting the injection heat exchanger and flowing in the branch flow channel to the intermediate injection channel or the suction injection channel.

3. A refrigeration apparatus that uses R32 as the refrigerant, the refrigeration apparatus comprising:

a compressor arranged and configured to suck in low-pressure refrigerant from a suction passage, to compress the refrigerant and to discharge high-pressure refrigerant;

a condenser arranged and configured to condense the high-pressure refrigerant discharged from the compressor;

an expansion mechanism arranged and configured to expand the high-pressure refrigerant exiting the condenser;

an evaporator arranged and configured to evaporate the refrigerant expanded by the expansion mechanism;

an intermediate injection channel arranged and configured to guide a part of the refrigerant flowing from the condenser toward the evaporator to the compressor, causing the refrigerant to merge with intermediate-pressure refrigerant of the compressor;

a suction injection channel arranged and configured to guide a part of the refrigerant flowing from the condenser toward the evaporator to the suction passage, causing the refrigerant to merge with low-pressure refrigerant sucked into the compressor;

a switching mechanism arranged and configured to switch between an intermediate injection condition in which refrigerant flows in the intermediate injection channel, and a suction injection condition in which refrigerant flows in the suction injection channel;

a branch flow channel branching from a main refrigerant channel joining the condenser and the evaporator;

an opening adjustable valve provided along the branch flow channel;

an injection heat exchanger arranged and configured to exchange heat between the refrigerant flowing in the main refrigerant channel and the refrigerant flowing downstream of the opening adjustable valve in the branch flow channel, the refrigerant exiting the injection heat exchanger and flowing in the branch flow channel to the intermediate injection channel or the suction injection channel;

a first temperature sensor arranged and configured to detect temperature of refrigerant discharged from the compressor;

a second temperature sensor arranged and configured to detect temperature of refrigerant that exits the injection heat exchanger and flows in the branch flow channel; and a control part selectively implementing intermediate injection control in which the intermediate injection condition of the switching mechanism is selected, or suction injection control in which the suction injection condition of the switching mechanism is selected, the control part in the intermediate injection control, adjusts the opening degree of the opening adjustable valve based on the detected temperature of the second temperature sensor when the temperature detected by the first temperature sensor is below a first threshold value, and adjusts the degree of opening of the opening adjustable valve based on the detected temperature of the first temperature sensor when the temperature detected by the first temperature sensor is higher than the first threshold value.

4. The refrigeration apparatus according to claim 1, further comprising a refrigerant storage tank provided along a main refrigerant channel joining the condenser and the evaporator, and a bypass channel arranged and configured to guide a gas component of the refrigerant accumulated inside the refrigerant storage tank to the intermediate injection channel or the suction injection channel.

5. The refrigeration apparatus according to claim 1, wherein the switching mechanism has a first opening/closing mechanism provided along the intermediate injection channel and a second opening/closing mechanism provided along the suction injection channel.

6. The refrigeration apparatus according to claim 1, wherein the switching mechanism is switchable between the intermediate injection condition, the suction injection condition, and a non-injection condition in which refrigerant does not flow to either the intermediate injection channel or the suction injection channel, the control part selectively implements the intermediate injection control, the suction injection control, and non-injection control in which the non-injection condition is selected, and the non-injection control is selectively implemented when the discharge temperature detected by the discharge temperature sensor is below the temperature threshold value, and the rotational speed of the compressor is below the rotational speed threshold value.

7. The refrigeration apparatus according to claim 3, wherein the switching mechanism is switchable between the intermediate injection condition, the suction injection condition and a non-injection condition in which refrigerant does not flow to either the intermediate injection channel or the suction injection channel.

8. The refrigeration apparatus according to claim 3, further comprising a refrigerant storage tank provided along a main refrigerant channel joining the condenser and the evaporator; and a bypass channel arranged and configured to guide a gas component of the refrigerant accumulated inside the refrigerant storage tank to the intermediate injection channel or the suction injection channel.

* * * * *